US011382407B2

(12) United States Patent
Young

(10) Patent No.: US 11,382,407 B2
(45) Date of Patent: Jul. 12, 2022

(54) REMOVABLE POCKET DEVICE CLIPS AND METHODS USING THEM

(71) Applicant: Hunter Young, Troutville, VA (US)

(72) Inventor: Hunter Young, Troutville, VA (US)

(73) Assignee: CQ Innovations, Inc., Troutville, VA (US)

( * ) Notice: Subject to any disclaimer, the term of this patent is extended or adjusted under 35 U.S.C. 154(b) by 0 days.

(21) Appl. No.: 17/034,222

(22) Filed: Sep. 28, 2020

(65) Prior Publication Data

US 2021/0112959 A1 Apr. 22, 2021

Related U.S. Application Data

(63) Continuation of application No. 15/223,883, filed on Jul. 29, 2016, now Pat. No. 10,786,070.

(60) Provisional application No. 62/256,591, filed on Nov. 17, 2015, provisional application No. 62/199,751, filed on Jul. 31, 2015.

(51) Int. Cl.

| | |
|---|---|
| ***A45F 5/02*** | (2006.01) |
| ***B26B 11/00*** | (2006.01) |
| ***B26B 1/10*** | (2006.01) |

(52) U.S. Cl.

CPC ..... *A45F 5/022* (2013.01); *B26B 1/10* (2013.01); *B26B 11/00* (2013.01)

(58) Field of Classification Search

CPC ..... A45F 5/022; B26B 11/00; B26B 1/10

See application file for complete search history.

(56) References Cited

U.S. PATENT DOCUMENTS

| | | | | | |
|---|---|---|---|---|---|
| 3,618,993 | A * | 11/1971 | Platte | B65D 67/02 | 52/713 |
| 4,447,950 | A * | 5/1984 | Mizelle | B26B 11/00 | 30/155 |
| 5,572,793 | A * | 11/1996 | Collins | B26B 3/06 | 30/155 |
| 5,704,129 | A * | 1/1998 | Glesser | B26B 1/02 | 30/123 |
| D402,177 | S * | 12/1998 | Glesser | D8/99 | |
| 6,540,122 | B1 * | 4/2003 | Petersen | A45F 5/02 | 224/197 |
| D474,669 | S * | 5/2003 | Onion | D8/99 | |
| D510,249 | S * | 10/2005 | Ray | D8/99 | |
| D560,996 | S * | 2/2008 | Onion | D8/99 | |
| D575,614 | S * | 8/2008 | Galyean | D8/99 | |
| 9,289,903 | B1 * | 3/2016 | Douzanis | B26B 1/10 | |
| 2002/0153395 | A1 * | 10/2002 | Martinez | B26B 29/025 | 224/232 |
| 2005/0194411 | A1 * | 9/2005 | Cooke | A45F 5/021 | 223/91 |
| 2005/0279787 | A1 * | 12/2005 | Davis | A45F 5/021 | 224/232 |
| 2006/0081666 | A1 * | 4/2006 | Chee | A45F 5/02 | 224/269 |

(Continued)

*Primary Examiner* — David M Upchurch

(74) *Attorney, Agent, or Firm* — Rhodes IP PLC; Christopher R Rhodes

(57) ABSTRACT

Certain configurations of a base and clip assembly that can couple to a pocket device are described. In some instances, the clip can removably couple to the base without the use of any external fasteners. Illustrations of the clip coupled to pocket devices such as knives, mobile devices and other devices that can fit into a pocket are also provided.

23 Claims, 29 Drawing Sheets

(56) References Cited

U.S. PATENT DOCUMENTS

| | | | | |
|---|---|---|---|---|
| 2006/0130337 | A1* | 6/2006 | Voros | B26B 1/048 30/153 |
| 2007/0289141 | A1* | 12/2007 | Caswell | B26B 11/00 30/160 |
| 2008/0302842 | A1* | 12/2008 | Hawk | A45F 5/022 224/269 |
| 2010/0267431 | A1* | 10/2010 | Fratti | A45F 5/02 455/575.6 |
| 2012/0047660 | A1* | 3/2012 | Lee | B26B 11/00 7/161 |
| 2015/0298295 | A1* | 10/2015 | Landon | B26B 1/02 30/138 |
| 2016/0023631 | A1* | 1/2016 | Chu | B43K 29/18 30/123 |

* cited by examiner

FIG. 1AC
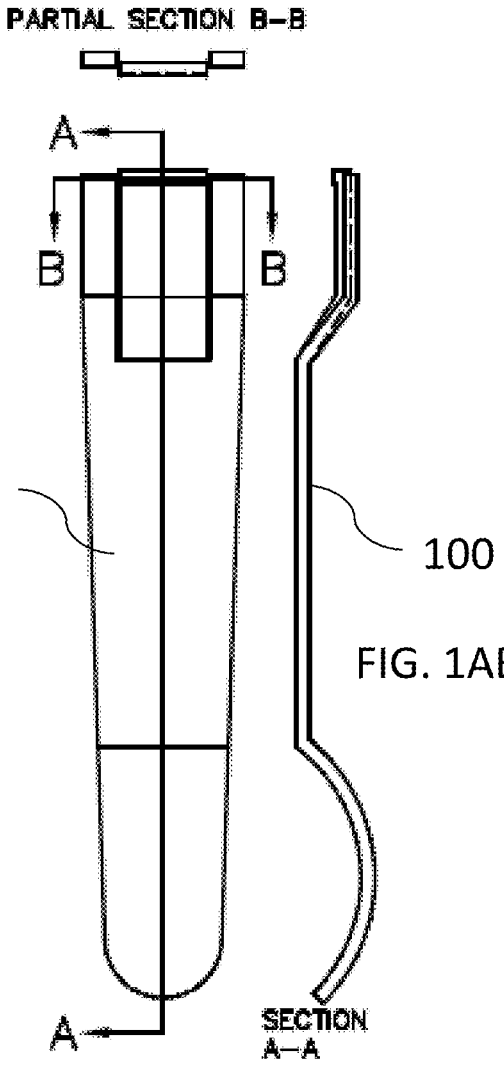
FIG. 1AB
FIG. 1AA
FIG. 1BC
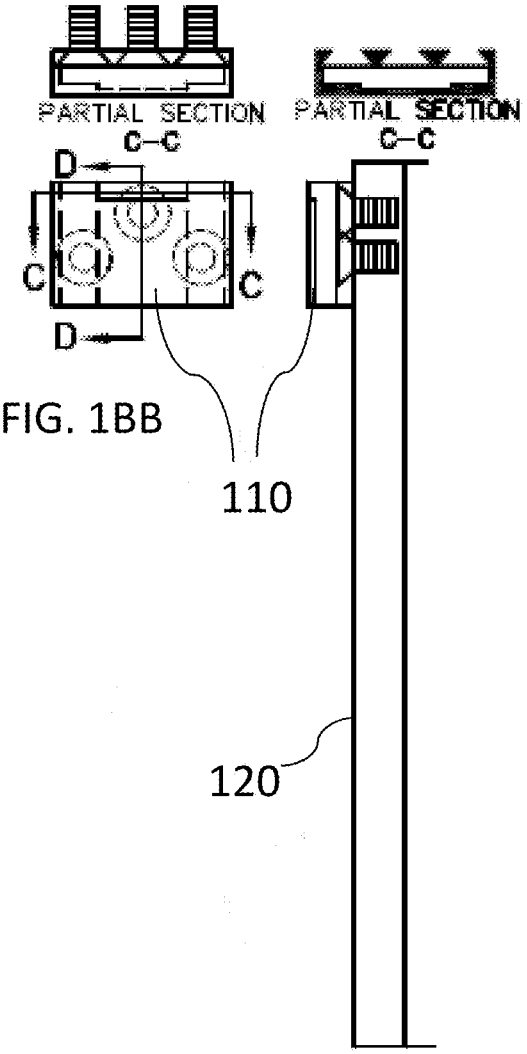
FIG. 1BB
FIG. 1BA

FIG. 5F
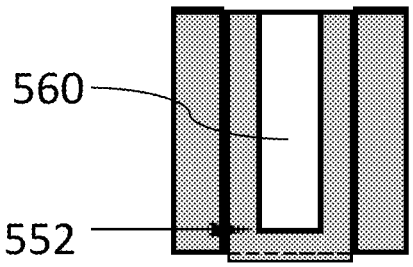
FIG. 5G
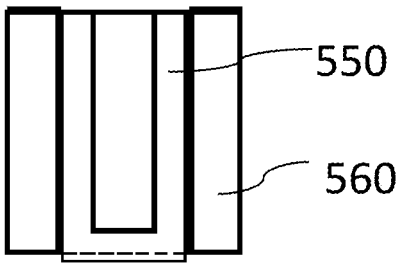
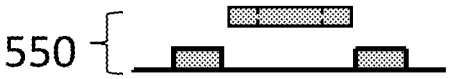
FIG. 5H
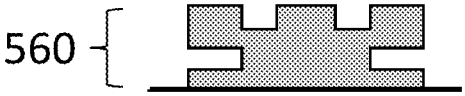
FIG. 5I
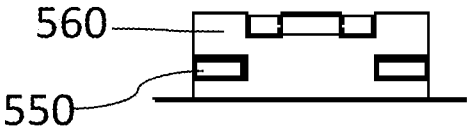
FIG. 5J
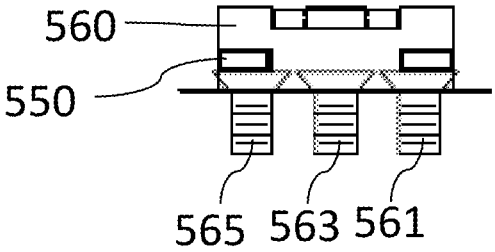
FIG. 5K

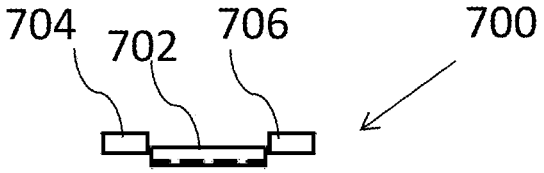
FIG. 7A
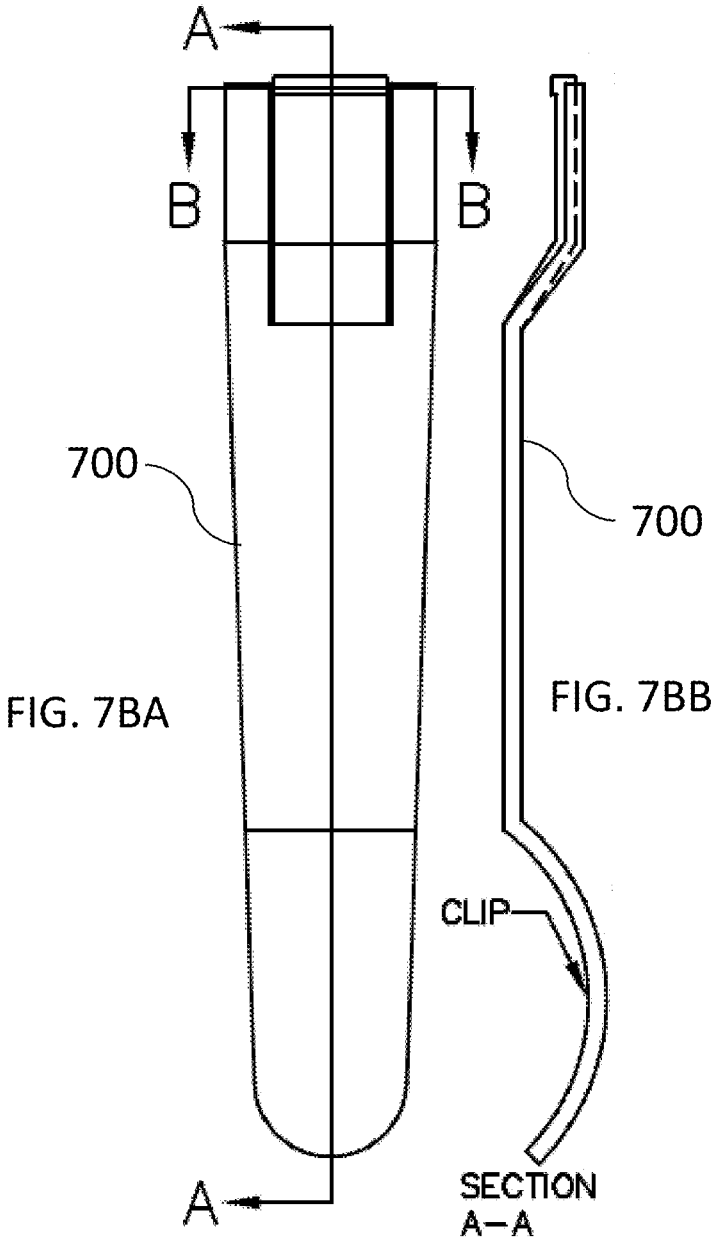
FIG. 7BA
FIG. 7BB

FIG. 8A
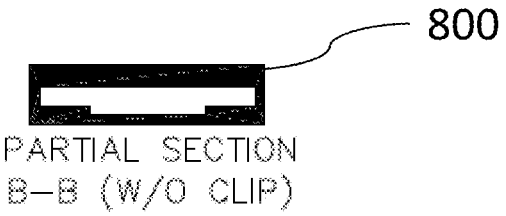
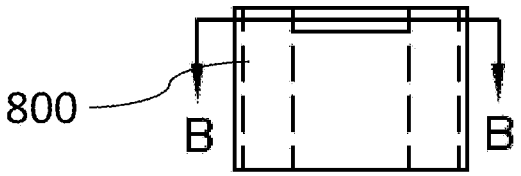
FIG. 8B
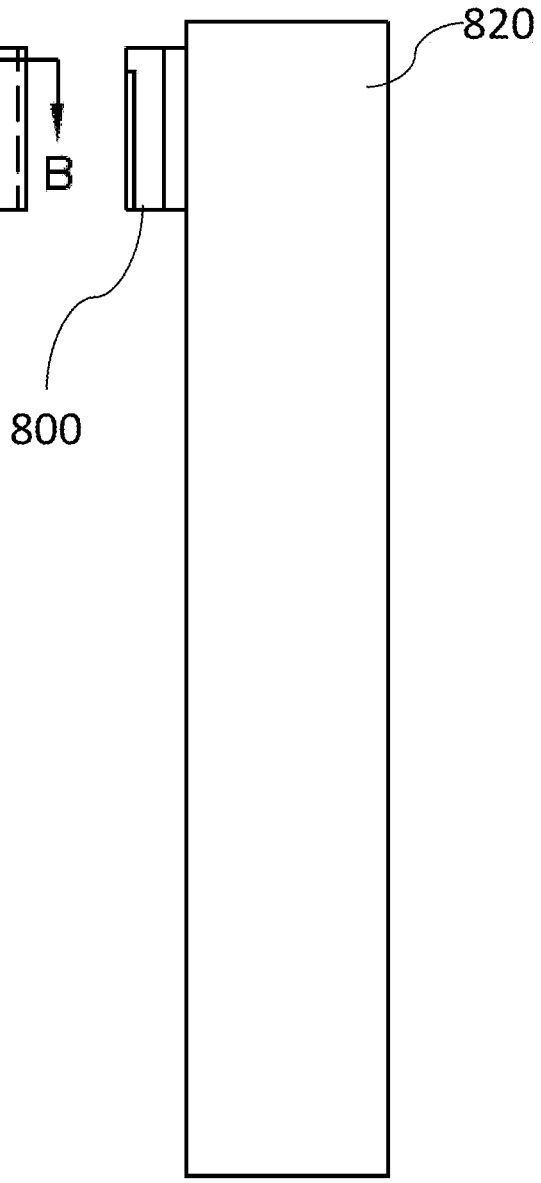
FIG. 8C

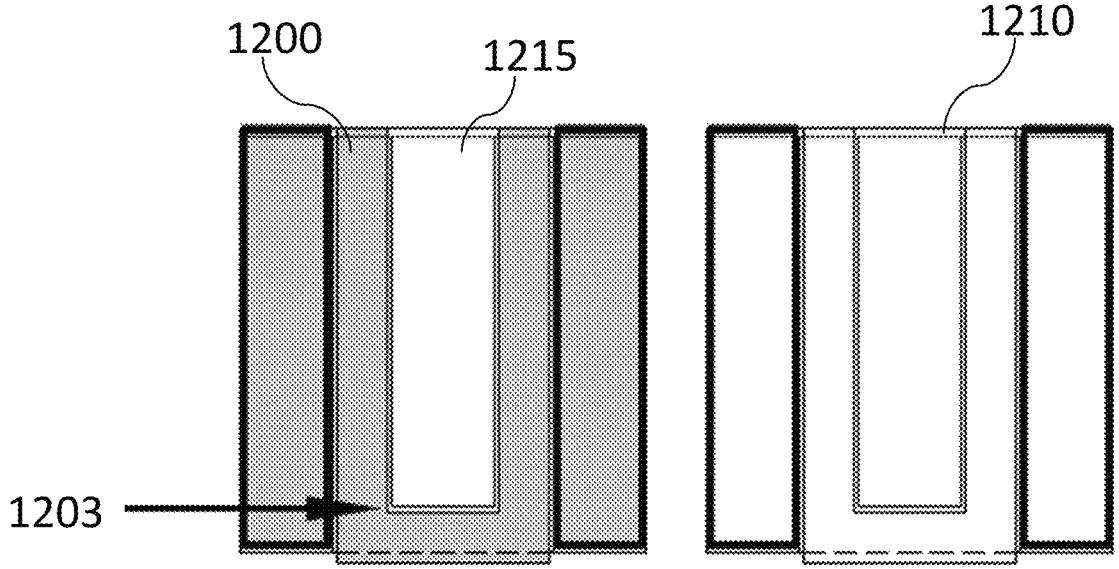
FIG. 12AA
FIG. 12AB
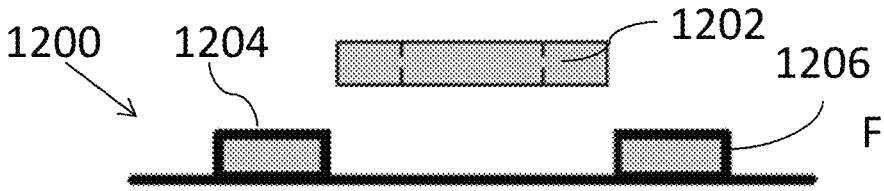
FIG. 12B
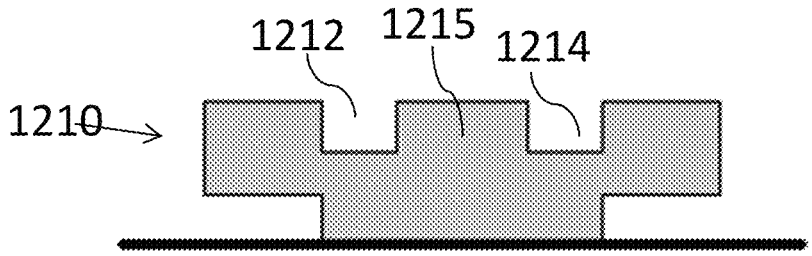
FIG. 12C
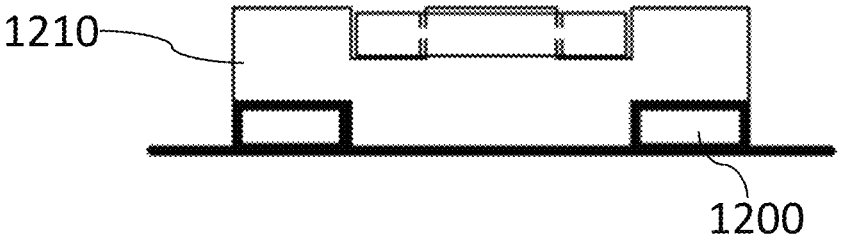
FIG. 12D

REMOVABLE POCKET DEVICE CLIPS AND METHODS USING THEM

PRIORITY APPLICATIONS

This application is a continuation-in-part of U.S. application Ser. No. 15/223,883 filed on Jul. 29, 2016. U.S. application Ser. No. 15/223,883 is related to, and claims priority to and the benefit of, each of U.S. 62/199,751 filed on Jul. 31, 2015 and U.S. 62/256,591 filed on Nov. 17, 2015, the entire disclosure of each of which is hereby incorporated herein by reference for all purposes.

TECHNOLOGICAL FIELD

This application is related to clips and assemblies using them. More particularly, certain embodiments described are directed to pocket devices which comprise a base configured to removably couple to a clip.

SUMMARY

In an aspect, a pocket knife clip assembly comprises a base configured to couple to a housing of the pocket knife, the housing sized and arranged to receive at least one knife blade and a clip configured to removably couple to the base. In certain embodiments, the clip comprises at least one finger that can reversibly couple to the base, wherein the at least one finger is configured to provide a spring force to retain the clip to the base after rotation of the clip to couple the clip to the base, and wherein rotation of the clip to couple the clip to the base aligns the clip parallel with a longitudinal axis of the pocket knife.

In certain configurations, the base is coupled to the housing of the pocket knife using one or more external fasteners or the base is integral to the housing. In other examples, the clip is configured to couple to the base through at least one slot on the base. In certain embodiments, the clip comprises a plurality of fingers, in which at least one finger is configured to engage a recess on the base. In some examples, the base comprises at least three recesses, and wherein a respective finger on the clip is configured to engage a respective recess on the base. In certain embodiments, the clip is configured to rotate at least 10 degrees, relative to the longitudinal axis of the knife, after the respective finger engages the respective recess to lock the clip in place. In other embodiments, the base comprises a radial slot that can receive at least one finger of the clip and lock the clip in place as the at least one finger engages the radial slot of the base. In certain embodiments, the base is configured to couple to the housing at an end of the housing to permit a bi-directional positioning of the clip.

In another aspect, a pocket knife clip assembly comprises a base configured to couple to a housing of the pocket knife, the housing sized and arranged to receive at least one knife blade, wherein the base comprises at least an inner element and at least one outer element that can pivot about the at least one inner element, and a clip configured to removably couple to the at least one outer element of the base without the use of any external fasteners, wherein the at least one outer element of the base is configured to pivot and align the clip parallel with a longitudinal axis of the pocket knife.

In certain embodiments, the at least one inner element comprises a spring and plunger, wherein the plunger is configured to engage the at least one outer element to retain the at least one outer element in place after pivoting of the at least one outer element. In some examples, the plunger is further configured to protrude through an opening in the clip to retain the clip to the at least one outer element and keep the clip parallel with a longitudinal axis of the pocket knife. In other embodiments, the at least one outer element is coupled to the inner element through a fastener configured to permit rotation of the at least one outer element. In certain examples, the at least one outer element comprises a slot configured to receive the clip and align a hole in the clip with a hole in the at least one outer element when a plunger of the at least one inner element engages the hole in the at least one outer element and the hole in the clip. In some examples, the at least one inner element comprises a slot to permit the spring to compress. In other embodiments, the clip further comprises fingers configured to engage recesses on the at least one outer element of the base. In some examples, the at least one inner element comprises a second plunger configured to engage a second hole on the at least one outer element to retain the at least one outer element in place. In other examples, the plunger is tapered.

In another aspect, a kit comprises a first clip configured to reversibly couple to a base coupled to a pocket knife, a second clip configured to reversibly couple to the base, wherein the second clip is different than the first clip, and written instructions to couple the first clip and the second clip to the base. In certain examples, the kit may also include one or more bases. In some embodiments, a second base different than the base is present in a kit.

In an aspect, a pocket knife clip assembly comprises a base configured to couple to a housing of the pocket knife, the housing sized and arranged to receive at least one knife blade and to permit folding and unfolding of the knife blade, and a clip configured to removably couple to the base without the use of any external fasteners is provided.

In certain examples, the base is integral to the housing of the pocket knife. In other examples, the base is coupled to the housing of the pocket knife using one or more external fasteners. In some instances, the clip is configured to couple to the base through a slot of the base. In further embodiments, the clip comprises a ball and the base comprises a socket, in which insertion of the ball of the clip into the socket of the base couples the clip to the base. In additional examples, the clip comprises a cam configured to couple to the base upon rotation of the clip. In additional instances, rotation of the clip into place may act to increase the tension between the clip and a pocket or other device to which the knife or other device is placed in. If desired, rotation may comprise multiple set positions or stops to permit adjustment of the clip in different positions to provide different amounts of tension in the different positions, e.g., to account for differences in thickness of the pocket, garment, etc. In other configurations, the clip comprises a plurality of spring members, in which at least one spring member is configured to retain the clip to the base once the clip is coupled to the base. In some embodiments, the base comprises a plurality of storage slots each configured to retain a clip. In other instances, the assembly comprises a second base on an opposite surface of the housing. In some examples, the base removably couples to the housing without the use of any screws.

In an additional aspect, a kit comprising a pocket knife clip, a base configured to couple to a housing of a pocket knife, in which the base is sized and arranged to reversibly couple to the pocket knife clip, and instructions for using the clip and the base to couple the housing of the pocket knife to the base and to couple the clip to the base of the pocket knife is disclosed.

In certain embodiments, the kit comprises a second pocket knife clip different from the pocket knife clip. In some embodiments, the kit comprises a plurality of pocket knife clips, in which each of the plurality of pocket knife clips is different. In other examples, the kit comprises a second base different from the base. In certain embodiments, the kit comprises at least one external fastener configured to couple the base to the housing of the pocket knife. In other examples, the clip is sized and arranged to couple to the base without the use of any external fasteners. In certain configurations, the clip is configured to couple to the base through a slot of the base. In other configurations, the clip comprises a ball and the base comprises a socket, in which insertion of the ball of the clip into the socket of the base couples the clip to the base. In additional configurations, the clip comprises a cam (or other device or devices) configured to couple to the base upon rotation of the clip. In some embodiments, the clip comprises a plurality of coupled spring members, in which at least one spring member is configured to retain the clip to the base once the clip is coupled to the base.

In another aspect, a mobile device assembly comprising a base configured to couple to a mobile device, and a clip configured to removably couple to the base without the use of any external fasteners is provided. In certain embodiments, the base is integral to the housing of the mobile device or integral to a cover that receives the mobile device through friction fit. In some examples, the base is coupled to the housing of the mobile device or a mobile device cover using one or more external fasteners. In other embodiments, the clip is configured to couple to the base through a slot of the base. In additional examples, the clip comprises a ball and the base comprises a socket, in which insertion of the ball of the clip into the socket of the base couples the clip to the base. In further embodiments, the clip comprises a cam (or other device or devices) configured to couple to the base upon rotation of the clip. In some instances, the clip comprises a plurality of spring members, in which at least one spring member is configured to retain the clip to the base once the clip is slidingly coupled to the base. In other examples, the base comprises a plurality of storage slots each configured to retain a clip. In some embodiments, the assembly comprises a second base different from the base. In some instances, the base removably couples to the mobile device without the use of any screws.

In an additional aspect, an assembly comprises a base configured to couple to a housing of a pocket device, and a clip configured to removably couple to the base without the use of any external fasteners, in which the clip is sized and arranged to engage a pocket opening to position the pocket device (at least partially) in a pocket and position a portion of the clip outside of the pocket.

In certain embodiments, the clip is configured for use with a flashlight configured to insert into the pocket and be hidden from view in the pocket when the clip engages the pocket opening. In other embodiments, the clip is configured for use with a wallet configured to insert into the pocket and be hidden from view in the pocket when the clip engages the pocket opening. In further embodiments, the clip is configured for use with a knife configured to insert into the pocket and be hidden from view in the pocket when the clip engages the pocket opening. In additional examples, the clip is configured for use with a firearm configured to insert into the pocket and be hidden from view in the pocket when the clip engages the pocket opening. In some instances, the clip is configured to engage an outer surface with an effective force to retain the pocket device in position in the pocket. In certain examples, the clip comprises a memory unit and a processor. In other embodiments, the processor is configured to provide a location of the clip using a GPS system. In further instances, the clip comprises a Bluetooth device. In some examples, the clip comprises at least one battery. In some embodiments, the battery is configured to charge the pocket device. In other embodiments, the assembly comprises a light integral to the clip, a speaker integral to the clip, a camera integral to the clip and combinations thereof. In other instances, the clip comprises a RFID chip, a Bluetooth device or both.

In other embodiments, the base comprises at least one battery. In certain examples, the battery of the base is configured to charge the pocket device. In certain examples, the assembly may comprise a light integral to the base. In other examples, the assembly may comprise a speaker integral to the base, a camera integral to the base or both. In certain embodiments, the base may comprise a RFID chip.

In certain embodiments, the clip (or the base or both) may comprise a display screen. In some examples, the display screen is configured to receive information from a mobile device wirelessly and display the received information from the mobile device. In other instances, the display screen is electrically coupled to the base or a mobile device or both and display information received from the mobile device. In some embodiments, the base comprises a battery. In other embodiments, the clip comprises a battery. In certain instances, the assembly may comprise a second clip, different from the clip, in which second clip comprises a display screen different from the display screen of the clip. In further examples, the second clip comprises a battery. In some embodiments, the assembly may comprise a second base different from the base.

In an additional aspect, a data storage device comprising a memory unit and a base configured to couple to a housing of the data storage device, and a clip configured to removably couple to the base without the use of any external fasteners is provided. The data storage unit may take many forms including USB drives, stick drives, SSD drive, portable memory units or drives and the like. The data storage unit may comprise, for example, a processor and/or communication device, e.g., Bluetooth device, WAN chip, LAN chip, etc. to permit sending of data from the storage device to another device, e.g., a mobile device.

In another aspect, an assembly comprising a base configured to couple to a housing of a pocket device, and clip means for removably coupling to the base without the use of any external fasteners, in which the clip means engages a pocket opening to position the pocket device in a pocket and position a portion of the clip outside of the pocket is disclosed.

Additional aspects, embodiments and examples are described in more detail below.

BRIEF DESCRIPTION OF THE FIGURES

Certain configurations are described in more detail below with reference to the accompanying figures in which:

FIGS. 5D and 5E are illustrations of a clip and base and FIGS. 5F, 5G, 5H, 5I, 5J and 5K are different views of the base and clip configuration of FIGS. 5D and 5E, in accordance with certain configurations;

FIGS. 7A-7BB are illustrations showing a clip that can be coupled to a base coupled to a mobile device, in accordance with certain examples;

FIGS. 8A, 8B and 8C are illustrations showing a base that can be coupled to a mobile device, in accordance with certain configurations;

FIGS. 12AA, 12AB, 12B, 12C and 12D are illustrations showing base and clip structures that can couple to a mobile device, in accordance with certain examples;

FIGS. 14A, 14B, 14C and 4D are illustrations showing a display screen integrated into the clip or base, in accordance with certain configurations;

Figure 1C:
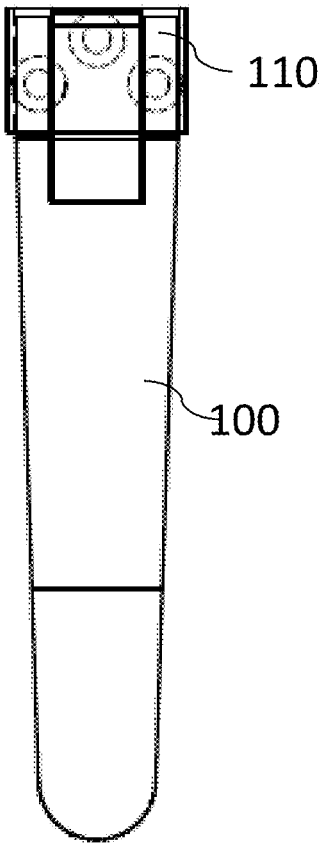
FIGS. 1AA, 1AB, 1AC, 1BA, 1BB, 1BC, 1C, 1D and 1E are illustrations showing a clip and base that can couple to a pocket knife, in accordance with certain configurations.

It will be recognized by the person of ordinary skill in the art, given the benefit of this disclosure, that the dimensions of one component of the figures are not necessarily to scale relative to the dimensions of another component in the figures. While illustrative dimensions are provided below for illustration purposes, these dimensions can be altered to provide a suitable size, thickness and/or configuration of the various device clips.

DETAILED DESCRIPTION

Certain configurations are described herein of pocket devices that can couple to a base. The base may be configured to removably couple to a clip which can be used, at least in part, to retain the pocket device in a pocket, e.g., in a front pocket, back pocket, cargo pocket, etc. The exact configuration of the pocket device may vary, and certain illustrative pocket devices are described below. The pocket device can be sized and arranged to fit in front pockets, back pockets, cargo pockets, coat pockets, etc., and the clip desirably functions to retain the device (to at least some degree) within the pocket to prevent loss of the device to which the clip is coupled, e.g., the clip is designed to work cooperatively with the base and the pocket to retain the pocket device in the pocket. As noted in more detail below, certain embodiments can include a generally fixed base that can receive and/or engage a removable or releasable clip. The releasability of the clip, without having to remove the base, permits different size clips, different color clips or different configured clips to be coupled to the base in a rapid and secure manner and without the need to use any tools to change out the clips. If desired, the base can be secured to the pocket device using one or more suitable fasteners.

In certain instances, the base may be a component which is added in addition to a cover or case that is used to protect or couple to the particular device. For example, where the device is configured as a pocket knife, the base may couple to covers of the pocket knife. Where the device is configured as a mobile device, the base may be configured to couple to a cover or sleeve that receives the mobile device. Notwithstanding that the base may couple to the device or a cover or sleeve coupled to the device, the base typically comprises a smaller form factor than the device or any cover or sleeve that can couple to the device to minimize the overall space occupied by the base. As noted below, the clip can be a separate component from the base, which can be detached from the base without detaching the base from the device.

In certain configurations described herein, a clip may couple to base and bear against the base. The presence of a base provides for additional spacing between the clip and the pocket device and permits coupling of different types of bases to the pocket device. The use of a two-piece (or more) assembly provides desirable attributes including the ability to customize the size of the clip and base, the shape and color of the clip and base and the particular functionality present in the clip and/or base.

In certain examples, a pocket knife clip assembly comprises a base configured to couple to a housing of the pocket knife. The housing of the pocket knife can be sized and arranged to receive at least one knife blade and to permit folding and unfolding of the knife blade. In other configurations, the knife may be housed within the housing in a first position and project from the housing in a second position. For example, a spring or other means can be present in the knife that when actuated causes the blade to project (or retract) from an end or side of the knife. A clip configured to removably couple to the base without the use of any external fasteners can be used to assist in retention of the pocket knife in the user's pocket. In some examples, the base is integral to the housing of the pocket knife. In other examples, the base is coupled to the housing of the pocket knife using one or more external fasteners, e.g., screws, rivets, hook-and-loop fasteners, adhesives and the like. In some embodiments, the clip is configured to couple to the base through a slot of the base.

Figure 1D:
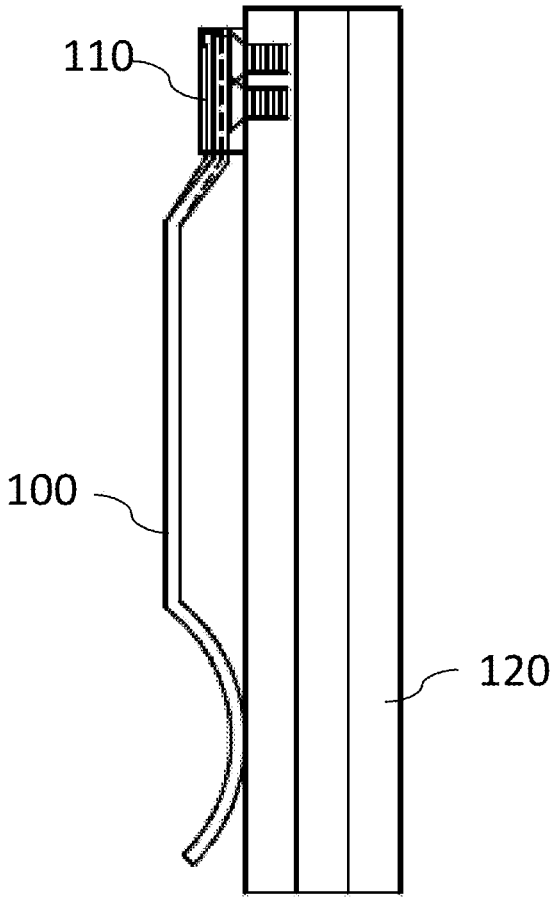
Figure 1E:
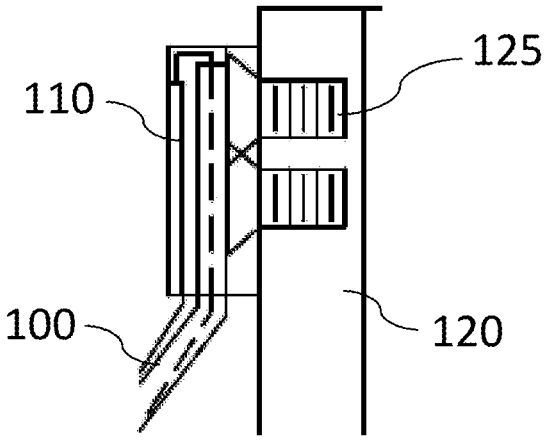

Referring to FIGS. 1AA-1E, a clip 100 is shown. The clip 100 may take many forms and shapes and desirably comprises a suitable structure to permit flexing and sliding of a portion of the pocket underneath the clip 100 without breaking the clip 100. For example, the clip 100 can be produced from spring steel, flexible plastics, elastomers or other suitable materials. In the configuration of FIGS. 1AA-1E, the clip 100 is split into three fingers or members, though fewer than three fingers may be present if desired. The outer fingers of the clip are substantially flat (see FIGS. 1AA, 1AB and 1AC). The inner finger is offset from the two outer fingers and may be raised or turned up at its edge to form a tab or projection. When the inner finger is compressed toward a plane formed by the outer two fingers, the entire clip 100 can be slid into a base 110 coupled to pocket knife 120. Once the fingers are inserted to their fill depth, the tab of the clip 100 will clear the base 110 and spring upward. The spring force acts to retain the clip 100 in the base 120 (see FIGS. 1D and 1E).

In certain embodiments, the base 110 may comprise one or more apertures that can receive a screw 125 or other fasteners to couple the base 110 to the knife 120. Similarly, the knife body itself may include an aperture that can receive a portion of a fastener to couple the base 110 to the knife 120. While three apertures are shown in FIGS. 1BA, 1BB, 1BC and 1C, fewer than three apertures may be present. In some instances, the apertures of the base 110 may be non-threaded and may be sized and arranged such the top surface of the fasteners sits flush with the base 110. This flush mounting may prevent the pocket device from being snagged or caught on other pieces of clothing. The housing of the knife 120 (see FIG. 1BA) may comprises threaded holes that can couple to threads of the fasteners to retain the base 110 (see FIG. 1BB) to the knife 120. In other configurations, the base 110 may be integral to the housing of the knife 120, e.g., molding in the housing of the knife 120, such that no fasteners are needed to couple the base 110 to the knife 120. In other instances, the base 110 may be coupled to the knife 120 through one or more intervening materials, e.g., adhesives, welds, brazes, solders, etc. Notwithstanding that the base 110 can be coupled to the knife 120 in many different manners or may be integral to the knife 120, the base 110 is generally not removable from the knife 120 by hand without destruction of the knife of without the use of some tools or other device to break or remove the physical coupling between the base 110 and the knife 120. In comparison, the clip 100 can be removed by depression of the tab with simultaneous sliding of the clip 100 out of the base.

Figures 2A, 2B:
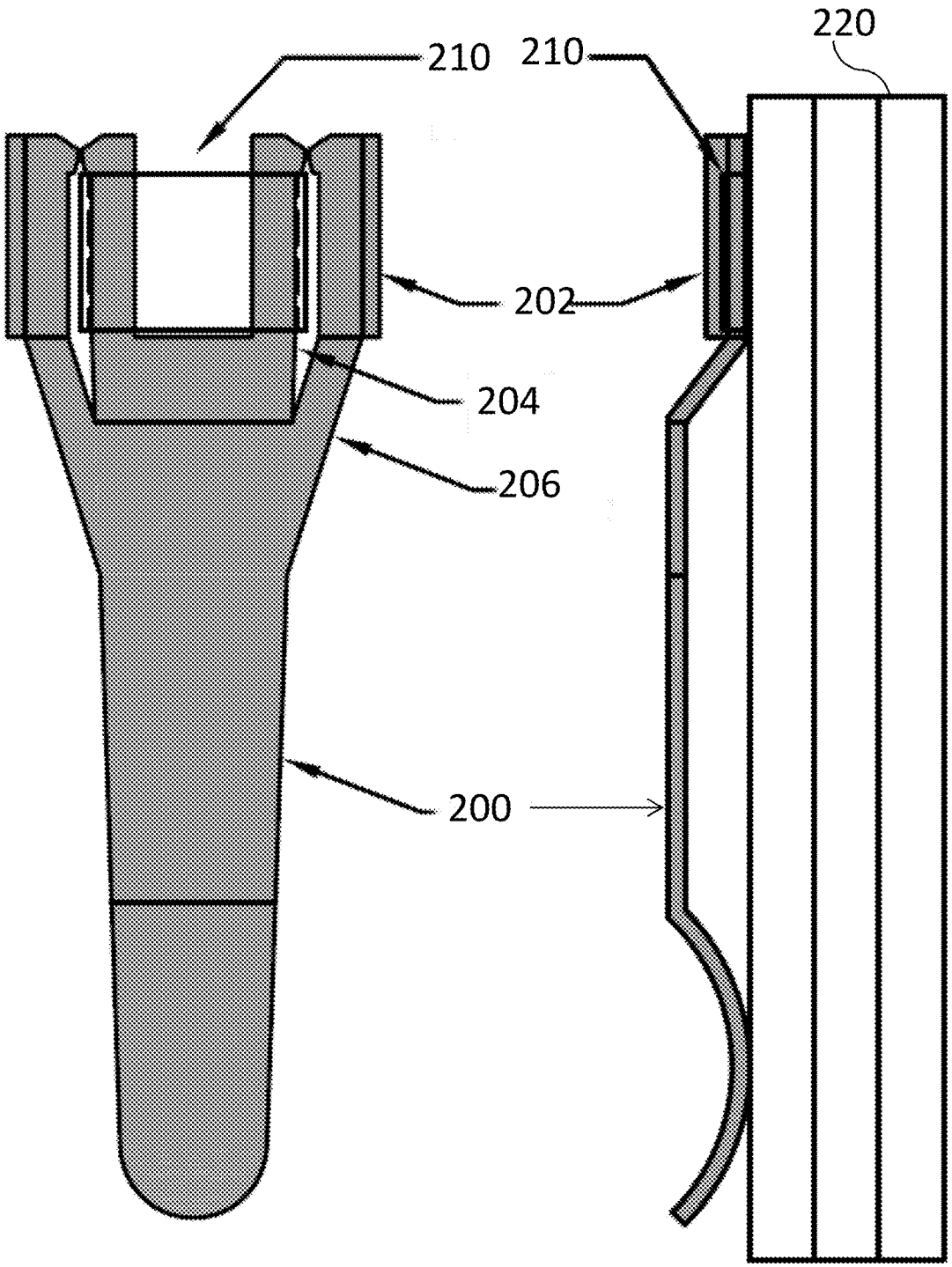
FIGS. 2A and 2B are illustrations showing a clip coupled to a pocket knife with an integral base, in accordance with certain configurations.
Figure 3A:
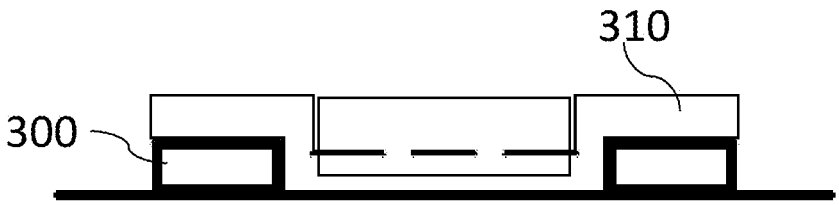
FIGS. 3A, 3C, 3C and 3D are illustrations of a base with a single slot that couples to a clip, in accordance with certain examples.
Figure 3B:
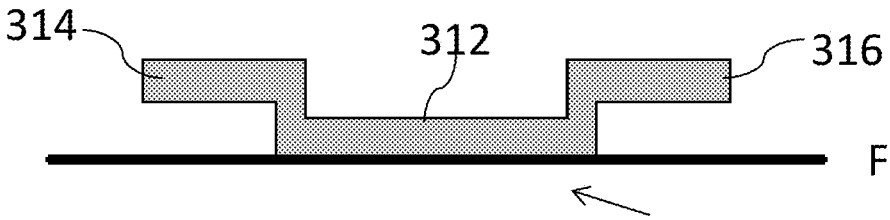
Figure 3C:
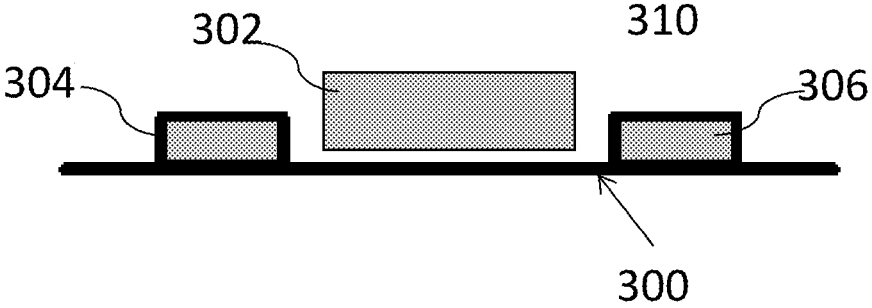
Figure 3D:
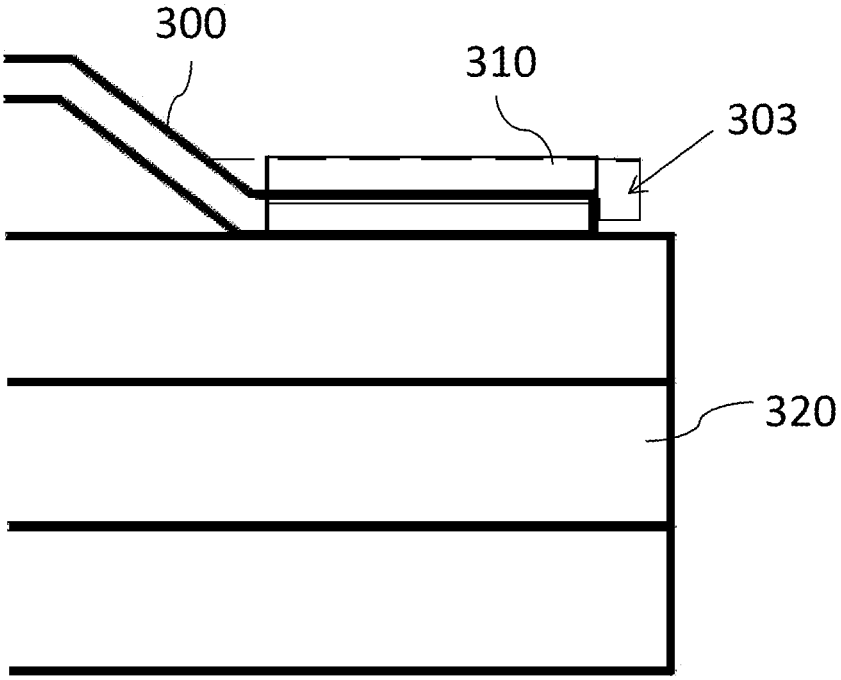
Figure 4A:
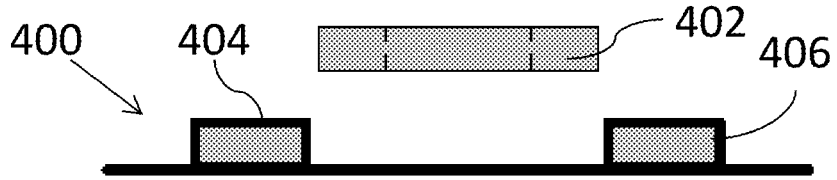
FIGS. 4A, 4B, 4C, 4D and 4E are illustrations of a base with two slots that couple to a clip, in accordance with certain configurations.
Figure 4B:
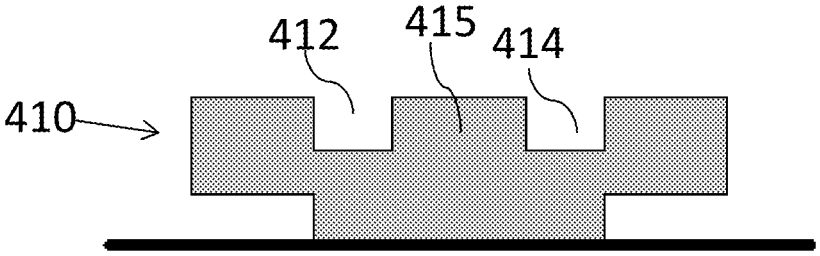
Figure 4C:
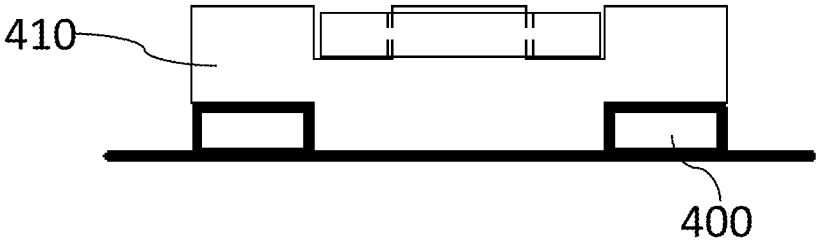
Figure 4D:
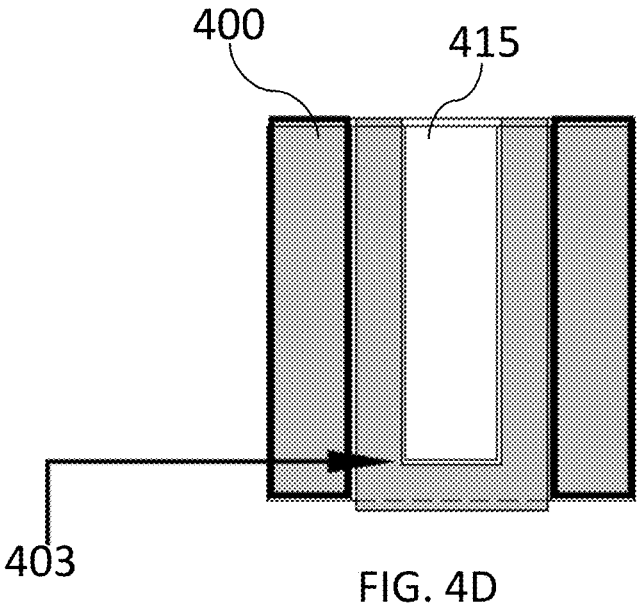
Figure 4E:
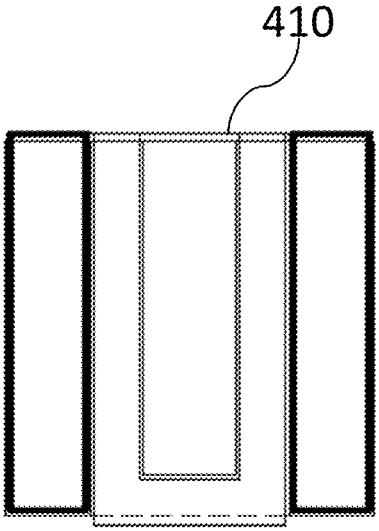

In certain embodiments and referring to FIGS. 2A and 2B, illustrations of a clip 200 coupled to a pocket knife 220 with an integral base 210 are shown. The clip 200 comprises a tab 202, an inner finger 204 and a pair of outer fingers 206. As noted in connection with FIGS. 1A-1E, depression of the tab 202 and upward movement of the clip 200 into a lower portion of the base 210 results in retention of the clip 200 in the base 210 as the tab 202 engages the base 210. While the clip 200 is shown in a resting position as contacting a planar surface of the housing of the knife 220, in some instances there may be a gap or space between the clip 200 and the knife 220 when the clip 200 is engaged to the base 210. For example, where the clip is designed for use with heavy clothing or thick pockets, it may be desirable to retain a slight gap between the clip 200 and the knife 220 so that the retention force exerted by the clip 200 in its use environment is not so high that the pocket knife 220 cannot be removed once it is engaged to a pocket through the clip 200.

In certain embodiments, the exact configuration of the base used to couple to the pocket knife may vary. Referring to FIGS. 3A-3D, illustrations of several components are shown. Clip elements 302, 304, 306 (FIG. 3C) can be designed to engage T-shaped base elements 312, 314, 316 (FIG. 3B) to couple a clip 300 to a base 310 (see FIG. 3A). The clip 300 is split into three fingers 302, 304, 306. The two side fingers 204, 306 slide between the top 314, 316 of the T-shaped base and the knife 320. The inner finger 302 slides across the top 312 and into a shallow slit. The end of the finger 302 may comprise a turned down portion 303 to permit the end 303 to engage the end of the base 310 when installed. To remove the clip 300, the end 303 would be pulled away from the housing of the knife 320 and the clip 300 would be slid away from the base 310 until the clip 300 is free. A different size or color clip can then be installed in the same manner.

In other instances, the base may comprise two or more slots to assist in retention of the clip to the base. Referring to FIGS. 4A-4D, illustrations of a base with more than a single slot are shown. A clip 400 comprises three different fingers 402, 404, 406 (see FIG. 4A). A base 410 comprises a first slot 412 and a second slot 414. The middle finger 402 of the clip 400 may comprise a cut or opening to permit a portion 415 of the base 410 to be positioned between the slots 412, 414 to engage the clip 400. The outer two fingers 404, 406 engage the base 410 underneath the base 400 and between the knife housing (not shown). If desired, the length of the finger 402 may extend beyond the edge of the base (see component 403 in FIG. 4D) to permit the finger 402 to rest against the base 410 and enhance coupling of the clip 400 to the base 410.

Figure 5A:
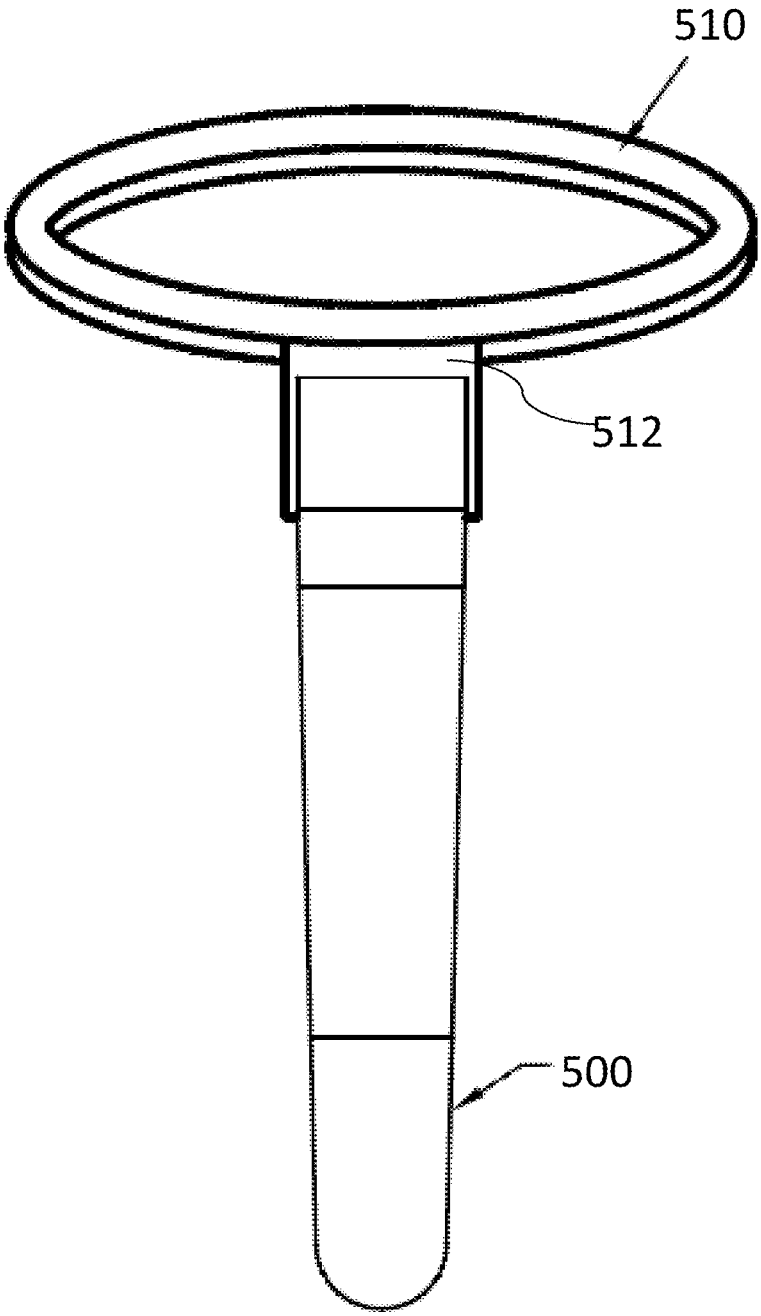
FIGS. 5A, 5B and 5C are illustrations of a flashlight that couples to base, in accordance with certain embodiments.

While the embodiments described in connection with FIGS. 1A-4E show bases which couple to a generally planar or flat surface, the clips and bases described herein can also be used with devices comprising non-flat surfaces including curved surfaces, raised surfaces or surfaces which are generally not flat where the base couples to the pocket device. Referring to FIG. 5A, a base 510 configured with a generally annular shape is coupled to a clip 500. The base 510 is sized and arranged to receive a pocket device either through a friction fit or may couple to the pocket device through fasteners (not shown) present at a portion 512 of the base 510.

Figure 5B:
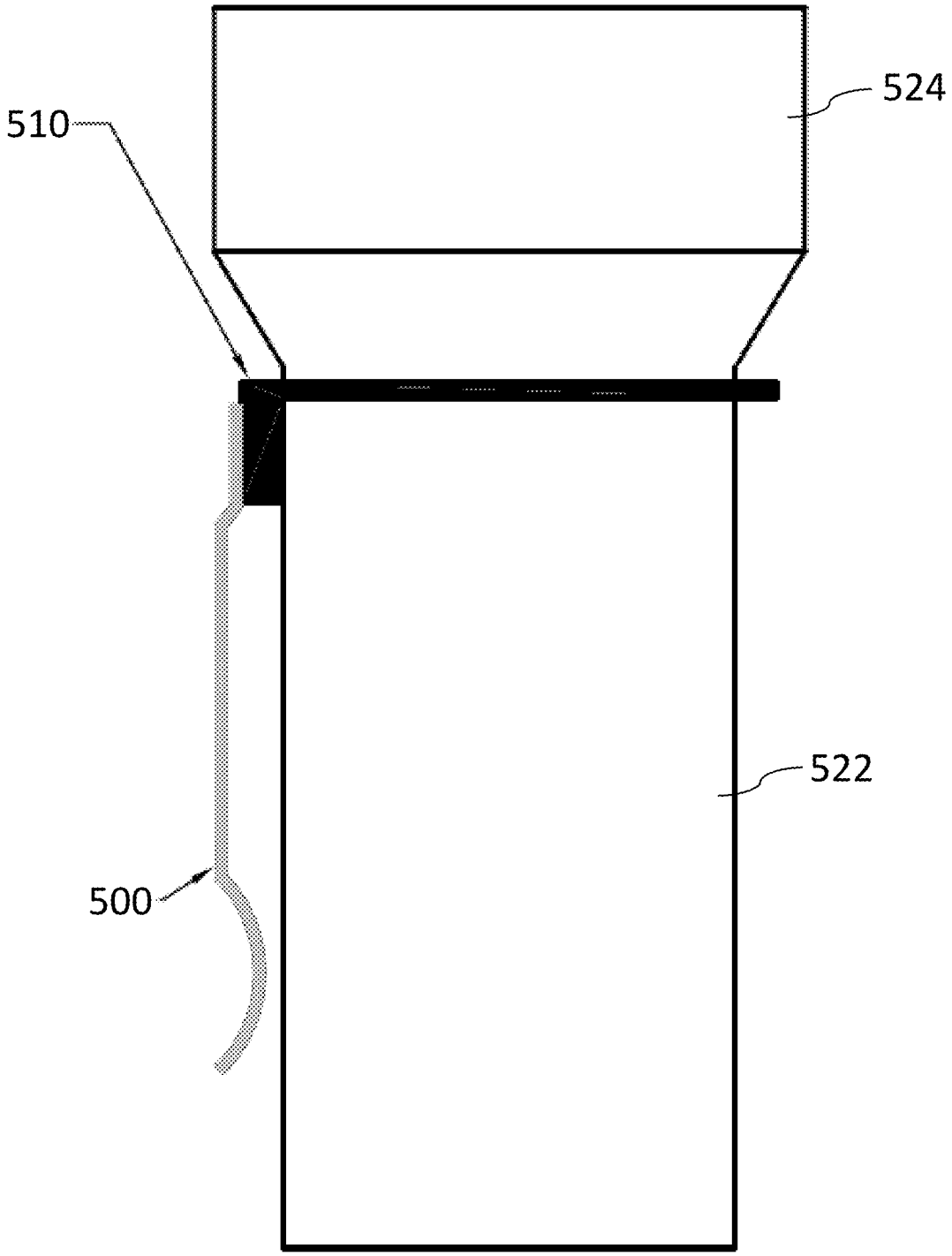
Figure 5C:
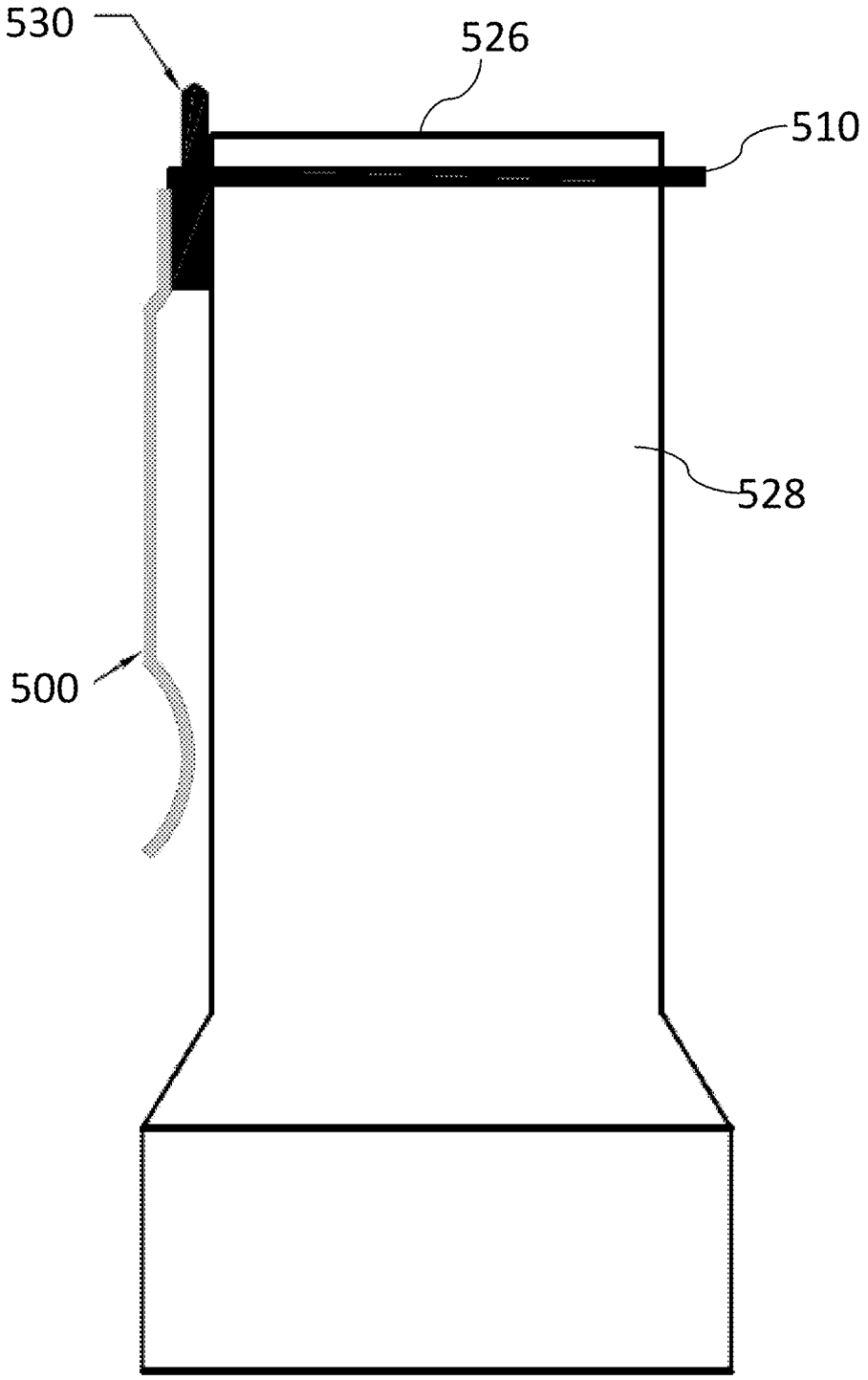
Figure 5E:
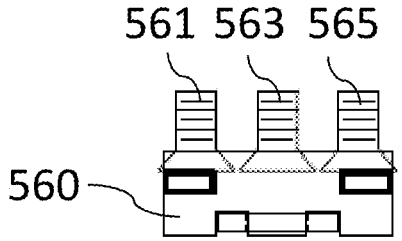

In some instances, the base 510 can be sandwiched between different portions of a pocket device. Referring to FIG. 5B, a flashlight is shown that comprises a handle 522 and a head 524. The head 524 may engage the handle through threads, e.g., can unscrew from the handle 522 to permit placement of batteries in the flashlight. When unscrewed, the base 510 can be placed over the threads of the handle 522, and the head 524 may be screwed back onto the handle 522. This action results in sandwiching of the annular base 510 between the components 522, 524. In some instances, the base 510 may function as both an engagement site for the removable clip 500 and as a gasket to seal the space between the head 524 and the handle 522. For example, the annular base 510 may be compressible such that coupling of the head 522 to the handle 524 results in compression of the base 510 and creation of a substantially fluid tight seal between the components 522, 524. Where a flashlight may permit loading of batteries at an end other than the end comprising a bulb or light source, the base 510 may instead be placed at that end. Referring to FIG. 5C, a base 510 is shown sandwiched between an end cap 526 and a handle 528. As noted in connection with FIG. 5B, the base 510 may provide a substantially fluid tight seal when the end cap 526 is engaged to the handle 528. An optional feature is shown in FIG. 5C and includes a glass breaker 530 coupled to the base. The glass breaker can be configured to provide highly concentrated force to permit the flashlight+base to break automotive glass. Alternate devices other than a glass breaker may also be coupled to the base 510.

While a flashlight is shown in FIGS. 5A-5C, any pocket device that may comprise two or more components can also be used with the sandwich base configuration. For example, writing instruments such as pens, laser pointers, game calls (e.g., duck calls, deer calls, turkey calls, etc.), water bottles, can or bottle koozies, 2-piece key chains and other similar devices can be used with the base 510. Further, the base 510 need not be attached in a sandwich configuration but may instead be attached using screws, adhesives, welds, brazes, soldering or other mechanical or chemical fasteners.

Figure 5D:
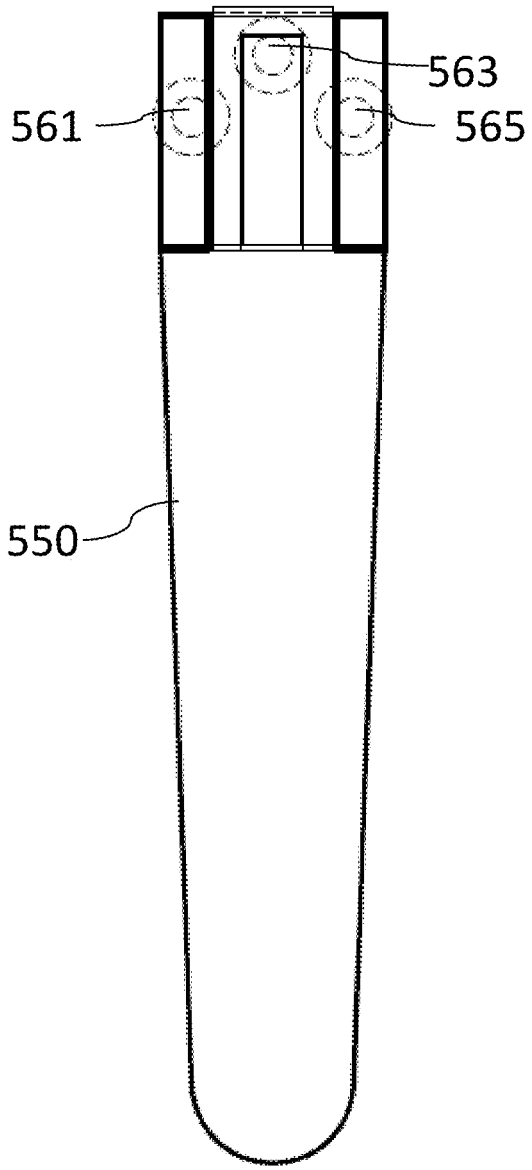

An additional clip and base configuration that can be used to couple to a round device is shown in FIGS. 5D-5K. Referring to FIGS. 5D and 5D, a clip 550 is shown coupled to a base 560. The base 560 is configured to receive three fasteners 561, 563 and 565 to couple to the base to a round pocket device (not shown). As shown more clearly in FIGS. 5F-5K, the base 560 has several slots. The clip's outer two fingers slide into the slots in the bottom of the base. The top of the base has two slots to accommodate a slot cut in the middle finger of the clip 550. The clip's middle finger engages a slot in the base and extends beyond the slots so the end 552 of the finger overlaps the end of the base 560.

Figure 6A:
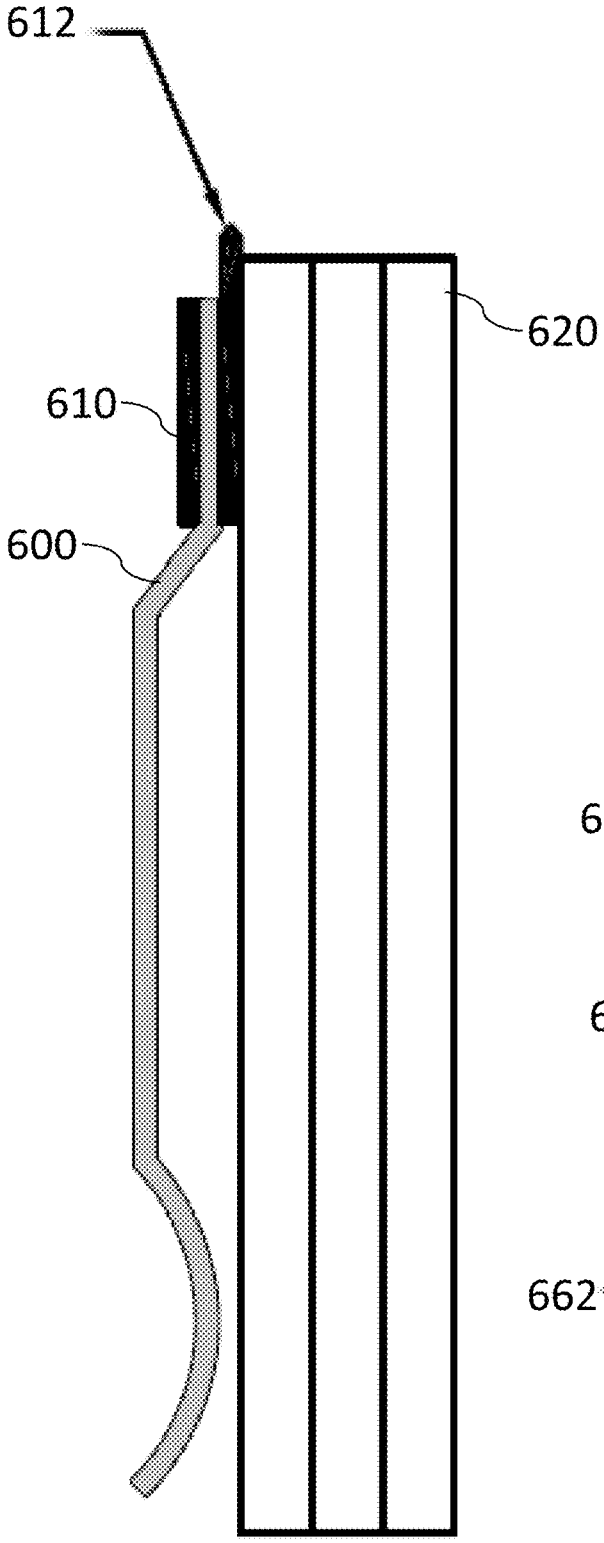
FIGS. 6A and 6B are illustrations showing extended bases, in accordance with certain examples.
Figure 6B:
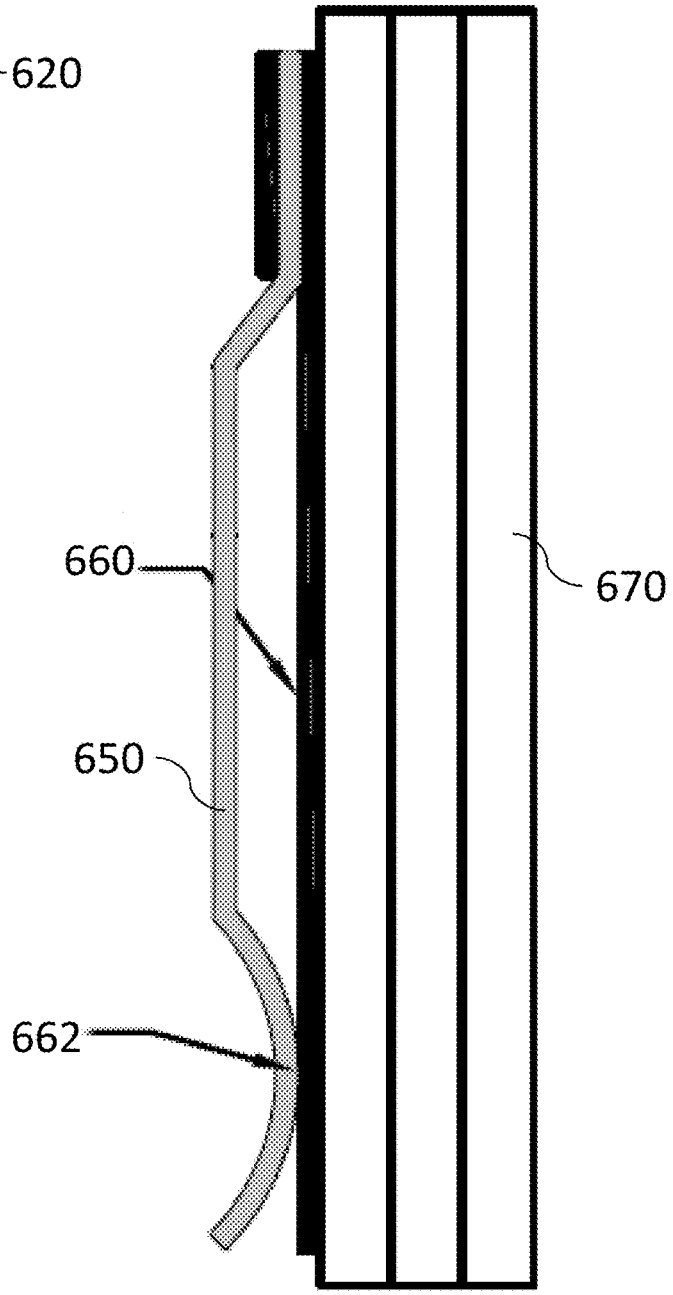

In certain embodiments, the base used with the pocket device may be oversized or comprise one or more extensions or extended portions. Referring to FIG. 6A, a base 610 is shown coupled to a knife 610 and a clip 600. The base has an extension portion 612 that can function as a glass breaker or compliance device. Alternatively, the extension portion 612 may be sized and arranged to couple to an accessory device such as a lanyard, glass breaker, key chain or other component as desired. In other instances, the base may extend in a direction along a longitudinal axis of the pocket device. For example and referring to FIG. 6B, a base 660 may extend along a planar surface of a pocket knife 660. The base 660 may be configured to contact a clip 650 at a portion 662 or may not make direct contact with the clip 650. The use of an extended base or an extension may permit coupling of the base to the pocket device in many different positions. In addition, the extended base or extension need not be continuous and may comprise openings, apertures, slots, depressions or other features.

Figure 9A:
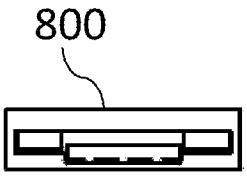
FIGS. 9A, 9B, 9C and 9D are illustrations showing a base, a clip and a mobile device coupled to the base and the clip, in accordance with certain examples.
Figure 9B:
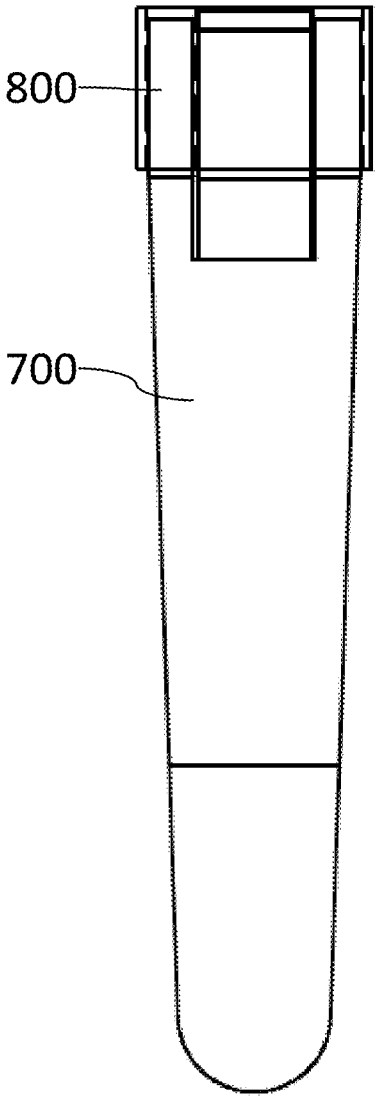
Figure 9C:
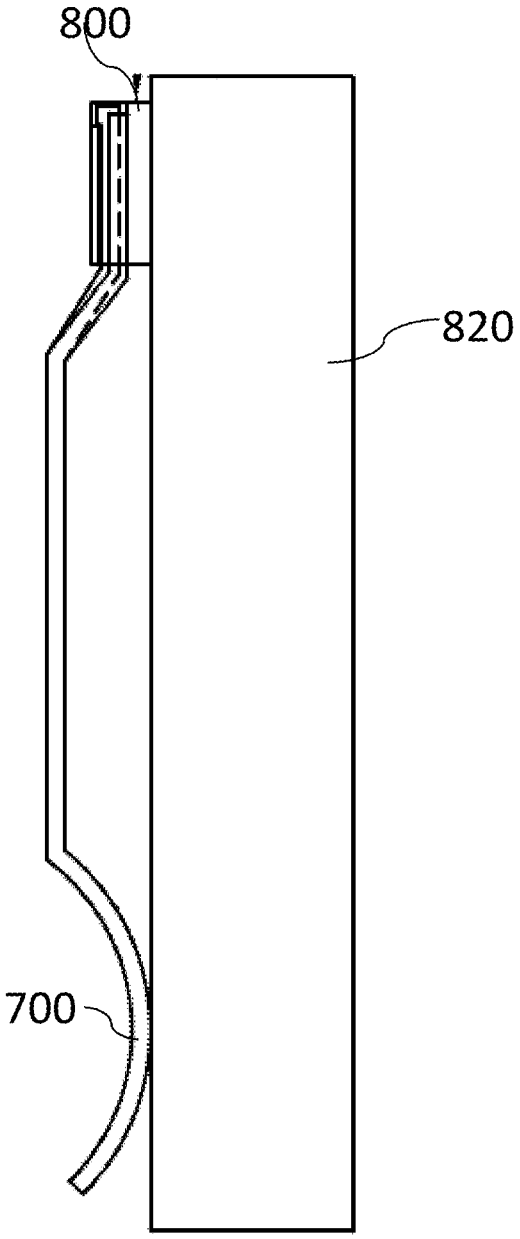
Figure 9D:
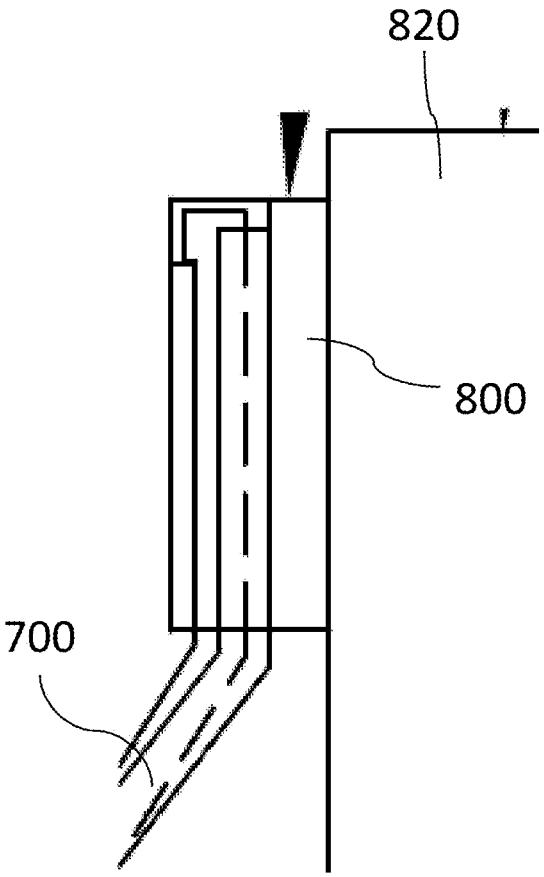

In certain embodiment, the pocket devices described herein may take the form of mobile device such as a cellular phone, tablet, personal digital assistant, digital music player or other portable electronic devices. The base may couple directly to the mobile device itself or may couple to a case or covering that receives the mobile device. Referring to FIGS. 7A, 7BA and 7BB, a clip 700 is shown that comprises three fingers 702, 704 and 706. The clip 700 may be produced using spring steel, plastic or other materials that are flexible at least to some degree. The inner finger 702 is offset from the other two fingers 704, 706 and can be turned up at its edge to form a tab. The clip 700 can reversibly couple to a base such as the base shown in FIGS. 8A-8C. The base 800 comprises a slot that can receive the finger 702 of the clip 700 by inserting the clip upward toward the base 800. When the base 800 is coupled to a mobile device 820, upward movement of the clip 700 results in engagement of the fingers 702, 704 70 to the base 800. Continued upper movement results in the tab of the finger 702 engaging a top surface of the base 800, which can act to retain the clip 700 in the base 800. FIG. 9A-9D are various illustrations showing the clip 700 engaged to the base 800, which itself is coupled to a mobile device 820. While a portion of the clip 700 is shown in FIG. 9C as contacting the mobile device 820, there may be space between the clip 700 and the mobile device 820 when the clip 700 is in a resting position.

In certain embodiments, the base 800 may be integral to a mobile device cover or housing or may be coupled to the mobile device directly. Alternatively, the base 800 may be coupled to a mobile device cover through one or more fasteners or by an aperture in the mobile device cover. For example, a mobile device cover may comprise an opening in a surface that can receive a flat base. The base may rest against the mobile device with a portion of the base extending though the opening. The friction fit between the mobile device and the mobile device cover can act to retain the base within the opening. A clip may then be coupled to the portion of the base which extends through the opening to permit a user to retain the mobile device in their pocket. Where a base extends through an opening in a mobile device cover or housing, the portion of the base that remains adjacent to the mobile device may be generally flat or planar so as to not interfere with retention of the mobile device by the cover or housing. In some instances, this portion of the base may also function as a cooling device and comprise suitable materials which can transfer heat away from the back surface of the mobile device. If desired, fins or slots in the base may permit some air flow into the mobile device cover to assist in keeping the mobile device cool.

Figures 10A, 10B:
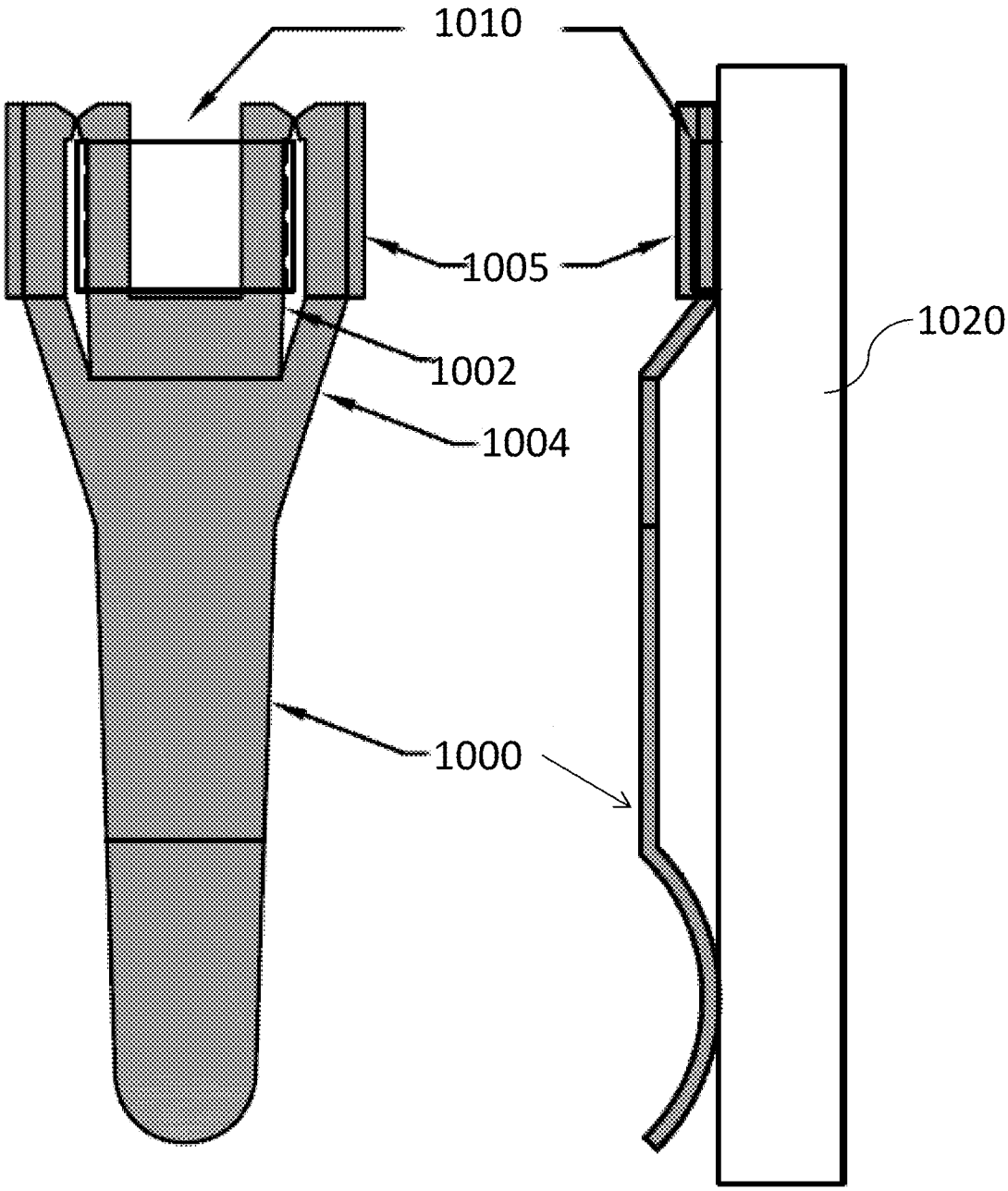
FIGS. 10A and 10B are illustrations of another configuration of a clip, in accordance with certain examples.
Figure 11A:
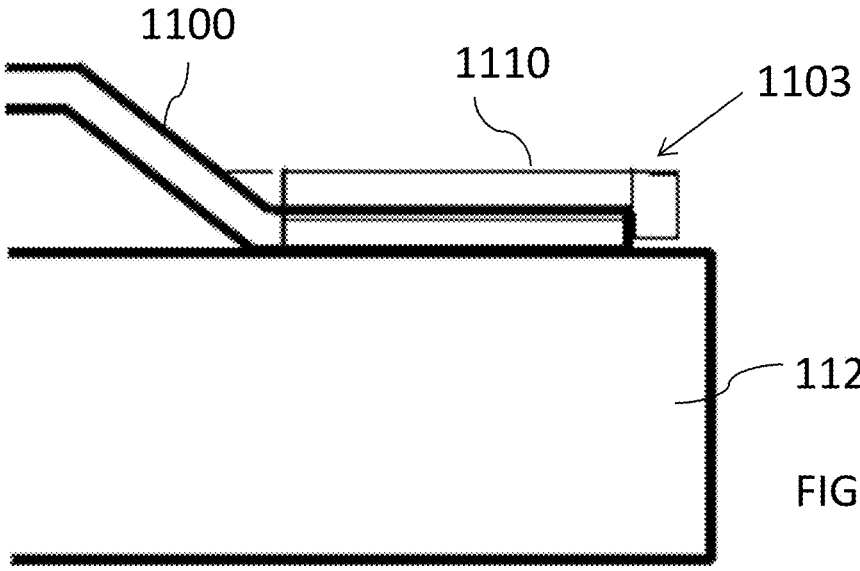
FIGS. 11A, 11C, 11C and 11D are illustrations showing base and clip structures that can couple to a mobile device, in accordance with certain embodiments.
Figure 11B:
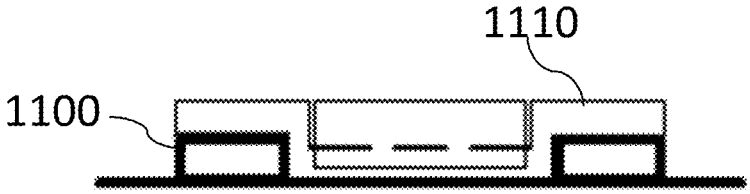
Figure 11C:
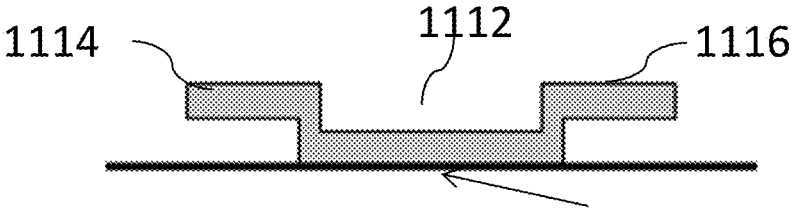
Figure 11D:
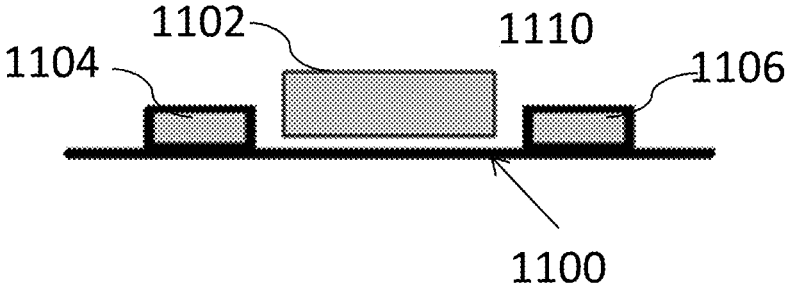

In certain embodiments and referring to FIGS. 10A and 10B, another configuration of a clip and base suitable for use with a mobile device is shown. The base 1010 is integral to the mobile device or a mobile device cover or housing. The clip 1000 comprises a tab, an inner finger 1002 and a pair of outer fingers 1004. The clip 1000 may be produced from spring steel or other flexible materials such as a polymer or elastomer. The fingers 1004 are generally flat, and the inner finger 1002 is offset and may form a tab 1005 at its edge. The clip 1000 can be slide upward into the base 1010. After insertion to its full depth, the tab 1005 will clear and spring outward to retain the clip 1000 to the base 1010. To remove the clip 1000, a user can depress the tab toward the mobile device and base 1010 while pulling downward. A new clip may then be inserted into the base.

In certain examples, the exact configuration of the base used to couple to the mobile device may vary. Referring to FIGS. 11A-11D, illustrations of several components are shown. Clip elements 1102, 1104, 1106 (FIG. 11D) can be designed to engage T-shaped base elements 1112, 1114, 1116 (FIG. 11C) to couple a clip 1100 to a base 1110 (see FIG. 11B). The clip 1100 is split into three fingers 1102, 1104, 1106. The two side fingers 1104, 1106 slide between the top 1114, 1116 of the T-shaped base and the mobile device 1120 or mobile device cover or case. The inner finger 1102 slides across the top 1112 and into a shallow slit. The end of the finger 1102 may comprise a turned down portion 1103 to permit the end 1103 to engage the end of the base 1110 when installed. To remove the clip 1100, the end 1103 would be pulled away from the housing of the mobile device 1120 and the clip 1100 would be slid away from the base 1110 until the clip 1100 is free. A different size or color clip can then be installed in the same manner.

In other instances, a base that can couple to a mobile device may comprise two or more slots to assist in retention of the clip to the base. Referring to FIGS. 12A-12D, illustrations of a base with more than a single slot are shown. A clip 1200 comprises three different fingers 1202, 1204, 1206 (see FIG. 12B). A base 1210 comprises a first slot 1212 and a second slot 1214 (se FIG. 12C). The middle finger 1202 of the clip 1200 may comprise a cut or opening to permit a portion 1215 of the base 1210 to be positioned between the slots 1212, 1214 to engage the clip 1200. The outer two fingers 1204, 1206 engage the base 1210 underneath the base 1200 and between the knife housing (not shown). If desired, the length of the finger 1202 may extend beyond the edge of the base (see component 1203 in FIG.

12AA) to permit the finger 1202 to rest against the base 1210 and enhance coupling of the clip 1200 to the base 1210 (see FIG. 12AB).

Figures 13A, 13B, 13C:
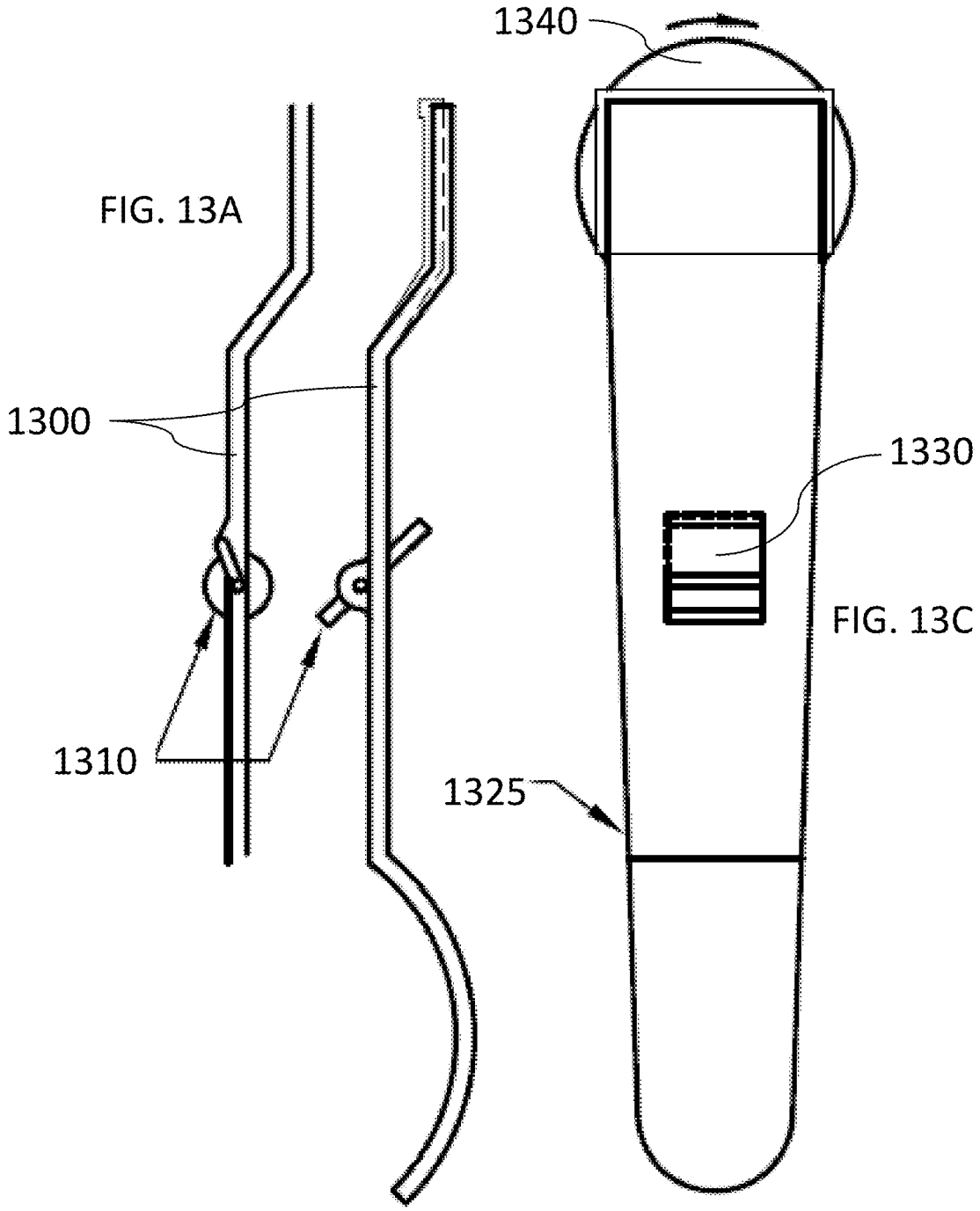
FIGS. 13A, 13B, 13C, 13D and 13E are illustrations showing different base configurations that can be used to couple to a mobile device, in accordance with certain examples.
Figure 13D:
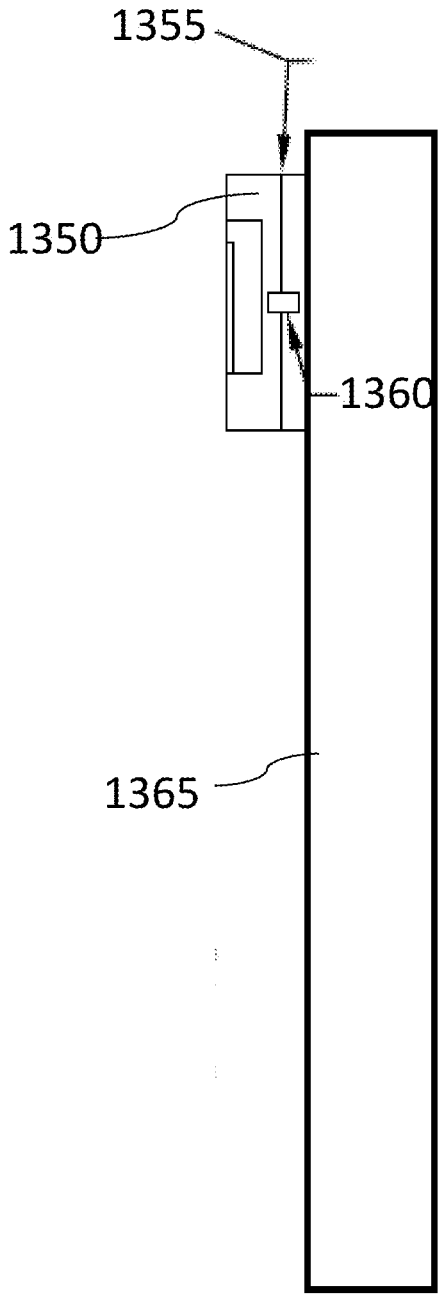
Figure 13E:
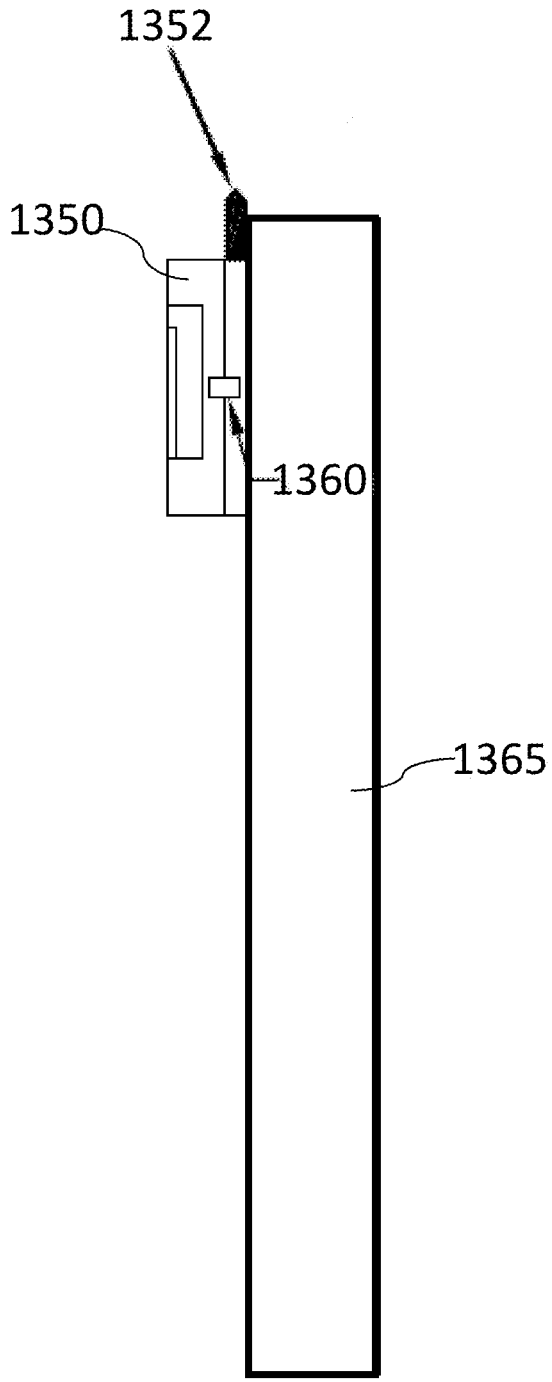

In certain embodiments, the clips described herein need not be fixed in position. For example, the clip may comprise one or more features that permit lateral movement, longitudinal movement, rotation or other movements. It may be particularly desirable to use a rotational clip with stops or detents to hold the clip in different positions. Depression of the clip, for example, may unlock the clip and permit rotation by another 360 degrees to decrease the distance between the clip and the device to which the clip is coupled. This configuration permits adjustment of the tension between the clip and the device to account for differences in pocket or garment thickness. In some instances, it may be desirable to configure the clip to permit some slipping. For example and referring to FIGS. 13A-13B, a clip 1300 comprises a pivoting member or rolling member 1310 that permits can provide some slip resistance. In some instances, the member 1310 may provide a friction force to resist movement of the clip in the pocket. Referring to FIG. 13C, a clip 1325 is shown that comprises a rolling member 1330. The clip 1325 is coupled to a rotatable base 1340, but in an alternative configuration the base can be fixed and a rotatable member can be present on the clip itself. The rotatable member may permit movement of the clip 1325 relative to the longitudinal axis of the pocket device so that the longitudinal axis of the clip and the longitudinal axis of the pocket device are not always parallel. A configuration with a rotatable base is shown in FIG. 13D. The rotatable base 1350 comprises a pivot plane 1355 and an axle 1360. The base 1350 can rotate angularly about the axle 1355 to permit adjustment of the position of the clip (not shown) relative to a mobile device 1365. Rotation of the base may be constrained by any desired devices or methods including, but not limited to, friction, detents, springs, etc. FIG. 13E shows a similar configuration but also includes an extension 1352 on the base 1350. The extension may comprise an accessory device such as those listed herein, e.g., may include a glass breaker, a RFID chip, a compliance device, a processor or may include other components.

In other configurations, the clip described herein may comprise a ball and the base may comprise a socket, in which insertion of the ball of the clip into the socket of the base couples the clip to the base. If desired, the friction between the ball and socket when coupled may be high such that the clip cannot rotate easily when the two components are engaged. In other configurations, the clip comprises a cam configured to couple to the base upon rotation of the clip. In additional configurations, the clip may comprise threads which can couple to threads of the base or the device in different positions. For example, rotation of the clip by 90 degrees may lock the clip into a first position. Depression of the clip toward the base or the device can permit rotation by another 360 degrees to a second position to lock the clip in the second position. If desired, additional rotation may be permissible to adjust the gap spacing between the clip and the base or between the clip and the device to which the clip is coupled. In some instances, the clip may comprise substantially flat fingers which radiate from the end of the spring clip. The fingers can be bent downward, e.g., at a 30 degree angle from the end of the clip. The base may comprise openings to accept these fingers. The clip is depressed into the opening in the base so the fingers are compressed. The clip is then rotated several degrees so they line up with slots in the base. When the user releases the compressive force, the fingers push the clip upward into the slots and hold it in place. Alternatively, a base may comprise its own springs that would push up against the clip.

In certain embodiments, the clips described herein may comprise one more spring members, e.g., a plurality of spring members, in which at least one spring member is configured to retain the clip to the base once the clip is coupled to the base. While certain embodiments described above are directed to a single spring member that remains outward in use, two or more different spring members could instead be used to enhance retention of the clip to the base.

In some embodiments, the base may comprise at least one storage slot, e.g., a plurality of storage slots, configured to retain a clip or more than one clip. For example, where the base comprises an extension or extends along the length of the pocket device, the base may be configured to receive a store an additional clip. The additional clip when stored may remain flush with the base surface so as to not interfere with use of the base and clip.

In some instances, the assembly may comprise a second base on an opposite surface, e.g., on an opposite planar surface or an opposite end, of the housing. For example, two different bases can be coupled to a pocket device at different positions. One base, for example, may be a fixed base which acts to keep the clip in a fixed position, and the other base may be a rotatable base which acts to permit rotation of the clip when coupled to the base. As noted herein in connection with the clip, it may be desirable to use a rotatable base which can be locked into different positions to permit adjustment of the spacing between the clip and the associated device. In another configuration, a first base may be configured to receive a second base. For example, a first base can be coupled to the pocket device and configured to receive a clip or a second base. When a second base is added, the second base can either be configured differently than the first base or may act as a spacer to provide additional separation between the clip and the pocket device.

In some examples, the bases described herein may removably couple to the housing without the use of any screws. In other instances, the bases described herein may couple to the base through removable fasteners, permanent fasteners, releasable adhesives, permanent adhesives, hook-and-loop fasteners or other means. In some instances, when in use the base typically cannot be separated from the base by application of a hand force but instead must be separated using one or more tools, heat or other means to break the mechanical or chemical connection between the base and the pocket device.

In some configurations, the clip may have a tab, boss or other element that the user would grip or pry with their fingers to help extract the pocket device from the pocket. The tab may comprise an opening or aperture that can receive the tip of an accessory tool, e.g., a punch, pen tip, key tip or the like, to assist the user in depressing the tab to release the clip from the base. If desired, the tool may be attached to the base through a lanyard or other means to facilitate a user separating the clip from the base.

In certain embodiments, the clips and bases described herein may be packaged in the form of a kit comprising a base configured to couple to a housing of a pocket device, a clip configured to couple to the base and instructions for using the clip and the base to couple the pocket device to the clip. In certain instances, the kit may comprise a plurality of different clips and/or bases to permit a user to select a particular clip/base pair for use with the pocket device. For example, the kit may comprise a second clip different from the first clip. In other embodiments, the kit may comprise at least one external fastener configured to couple the base to the housing of the pocket knife. In certain examples, the clip is sized and arranged to couple to the base without the use of any external fasteners, e.g., the kit is provided without any external fasteners. In certain configurations where a base is integrated into the pocket device, the kit may only comprise a clip and instructions for using the clip to couple the clip to the integral base of the pocket device.

In other embodiments, the components described herein may take the form of an assembly comprising a base configured to couple to a housing of a pocket device, and a clip configured to removably couple to the base without the use of any external fasteners, in which the clip is sized and arranged to engage a pocket opening to position the pocket device in a pocket (at least partially) and position a portion of the clip outside of the pocket is disclosed. In certain examples, the clip is configured for use with a flashlight configured to insert into the pocket and be hidden from view (at least partially) in the pocket when the clip engages the pocket opening. In other examples, the clip is configured for use with a wallet configured to insert into the pocket and be hidden from view in the pocket when the clip engages the pocket opening. In some examples, the clip is configured for use with a pocket knife configured to insert into the pocket and be hidden from view (at least partially) in the pocket when the clip engages the pocket opening. In certain embodiments, the clip is configured for use with a firearm configured to insert into the pocket and be hidden from view (at least partially) in the pocket when the clip engages the pocket opening. In other embodiments, the clip is configured to engage an outer surface with an effective force to retain the pocket device in position in the pocket.

In certain configurations, the clip comprises a memory unit and a processor. In other embodiments, the processor is configured to provide a location of the clip (and any device coupled to the clip) using a GPS system or other tracking system that provides a signal from a processor of the whereabouts of the clip. For example, the GPS unit may be used to assist the user possessing the pocket device in finding a location or may assist the user in locating a lost or misplaced pocket device comprising the GPS unit. In some examples, the clip comprises a Bluetooth device. In further embodiments, the clip comprises at least one battery. In some examples, the battery is configured to charge or power the pocket device. If desired, the battery may comprise a wired or wireless coupler which can be configured to charge the battery from a power source, e.g., an AC power source, DC power source, another battery, a fuel cell, a solar cell, etc. Similarly, the battery itself may be coupled to the pocket device in wired or wireless manner. In certain embodiments, the clip may comprise an integral light. In some examples, the clip comprises an integral speaker, an integral camera, or an RFID chip.

Figure 14A:
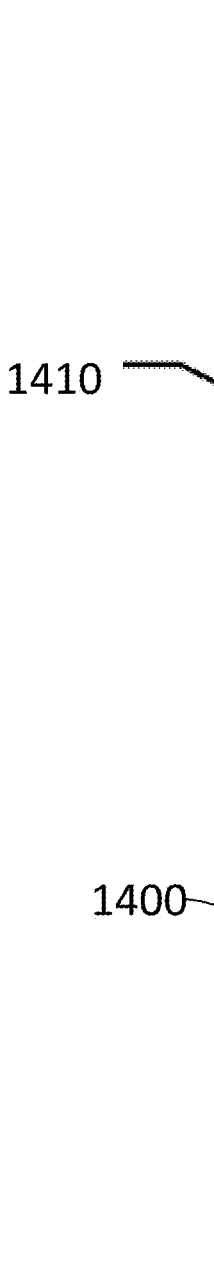
Figure 14B:
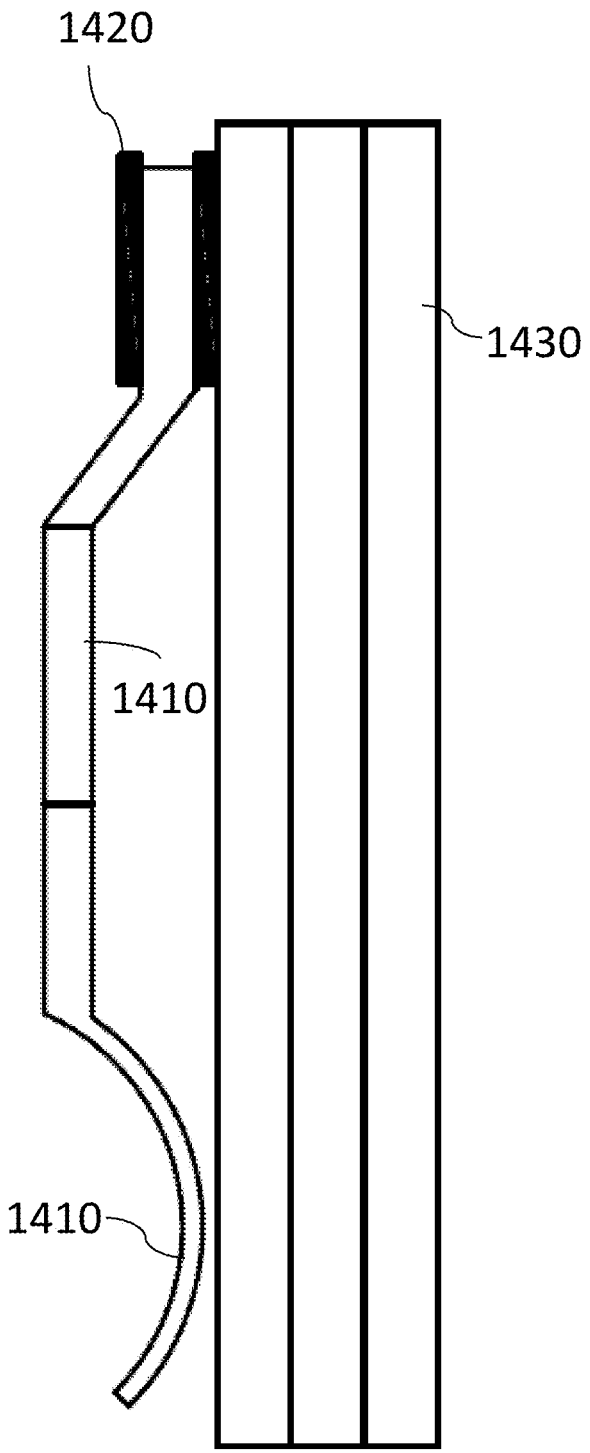
Figure 14C:
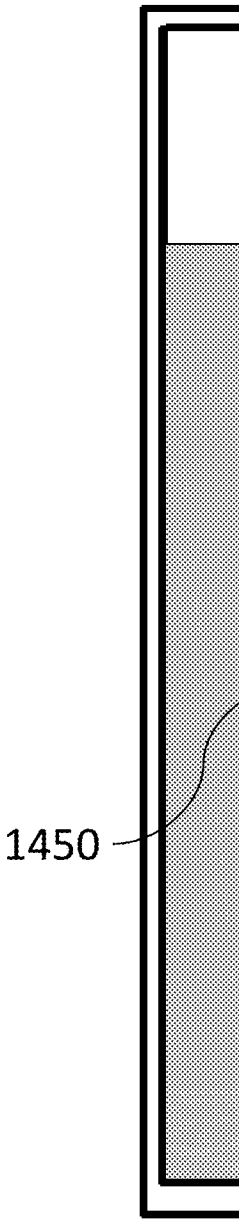
Figure 14D:
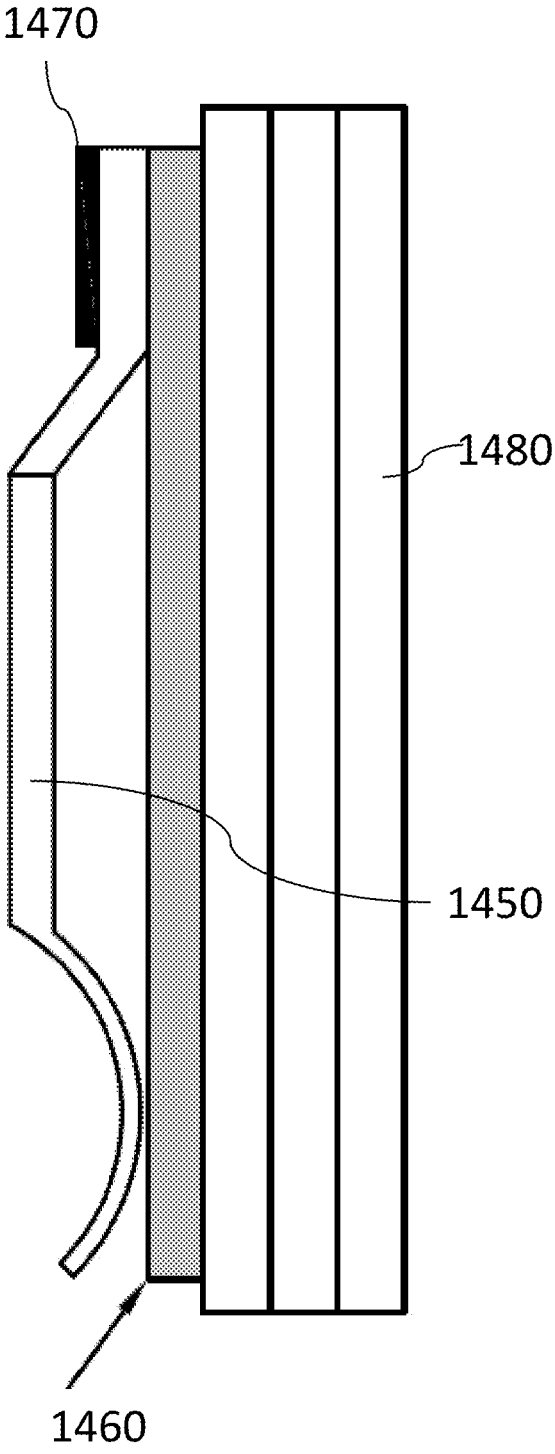

In some embodiments, the clip may be configured with a small display, e.g., LCD screen, that can receive information from the pocket device and display that information. For example, the clip may comprise a narrow LCD screen that can display incoming text messages, phone calls, e-mails, etc., so the user can view that information without needing to unlock or access the mobile device. In some instances, the screen may be powered by the mobile device itself, or the clip may include an on-board battery, fuel cell, or the like which can power the screen. In additional configuration, the base may comprise a battery, fuel cell or the like which can electrically couple to the clip to provide power to the screen of the clip. The base may further be electrically coupled to the mobile device such that charging of the mobile device also charges the battery of the base. In other configurations, the base comprises a Bluetooth device. In some embodiments, the base comprises at least one battery. In certain examples, the battery in the base is configured to charge or power the pocket device. In some examples, the base may comprise one or more of an integral light, an integral speaker, an integral camera, or an RFID chip. Referring to FIGS. 14A and 14B, illustration are shown of a clip 1400 comprising a display 1410 (which instead, or in addition to, might be a speaker, Bluetooth device, GPS device, RFID chip, camera, light, battery, memory unit, processor, etc.) integral to the clip 1400. The clip 1400 can couple to a base 1420 which itself can be coupled to a pocket device 1430. An alternative configuration is shown in FIGS. 14C and 14D where the display 1460 is integral to the base 1470. A clip 1450 can couple to the base 1470 as shown. A pocket device 1480 can be coupled to the base 1470. The display 1460 may alternatively be, or in addition to a display be, a speaker, Bluetooth device, GPS device, RFID chip, camera, light, battery, memory unit, processor. The clip or base may comprise suitable electrical couplers to provide power and/or electrical signals to the display integral to the clip or screen. Where the display is integral to the base, then display may be configured to display information (e.g., time, date, text, etc.) above and/or below the clip, when the clip is coupled to the base, to permit the user to review the information without having to remove the clip. If desired, the display can wirelessly receive information from a mobile device or other device or may comprise suitable couplers, e.g., USB couplers, Apple® lightning adapter couplers or other suitable coupler, to provide information to the display and/or charge any on-board power supply. In certain configurations, the clip, base or both may comprise a data storage device comprising a memory unit, a base configured to couple to a housing of the data storage device, and a clip configured to removably couple to the base without the use of any external fasteners is provided.

Figure 15A:
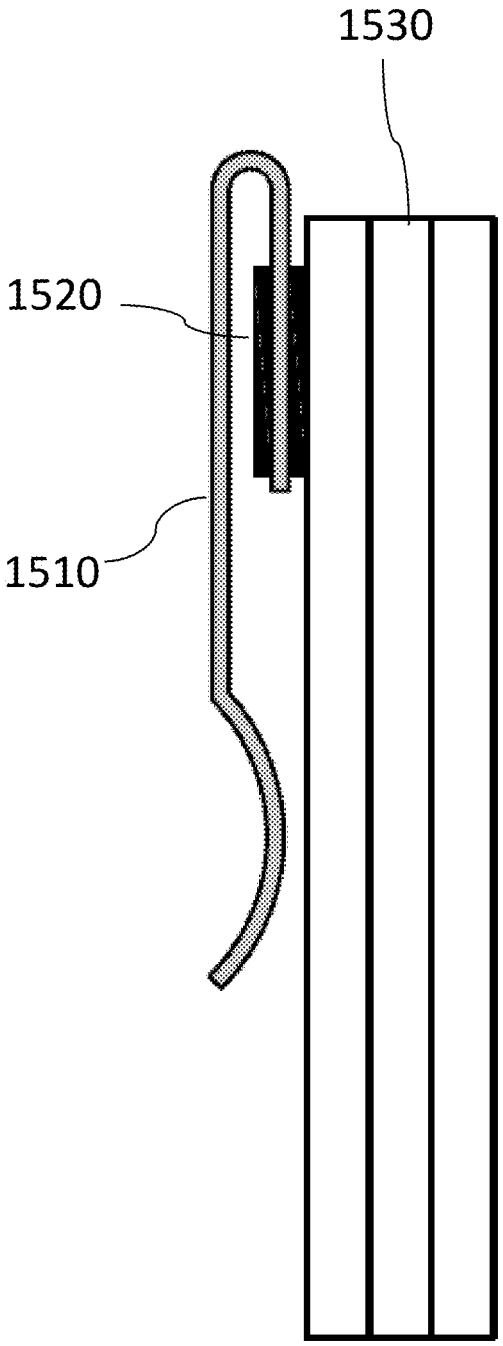
FIGS. 15A and 15B are illustrations showing a base/clip design to hide the device from view when the clip is placed, in accordance with certain examples.
Figure 15B:
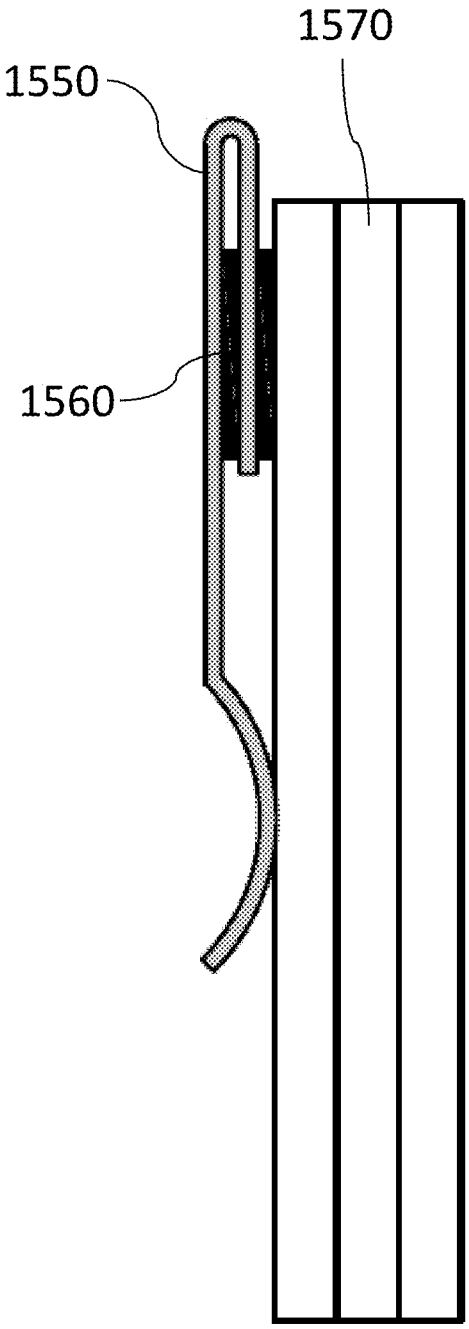

In some configurations, the clip and/or base may be configured to permit hiding of the device when the clip is placed on a pocket. Referring to FIG. 15A, a clip 1510 and base 1520 is shown coupled to a device 1530. The clip is configured to permit the pocket to engage an upper surface of the clip to permit the mobile device 1530 to remain hidden when inserted into a pocket. Referring to FIG. 15B, a clip 1550 and base 1560 are shown coupled to a device 1570. The clip 1560 comprises a suitable length to permit the device 1570 to be hidden when the clip 1550 is engaged to a pocket.

Figures 16A, 16B, 16C, 16D, 16E:
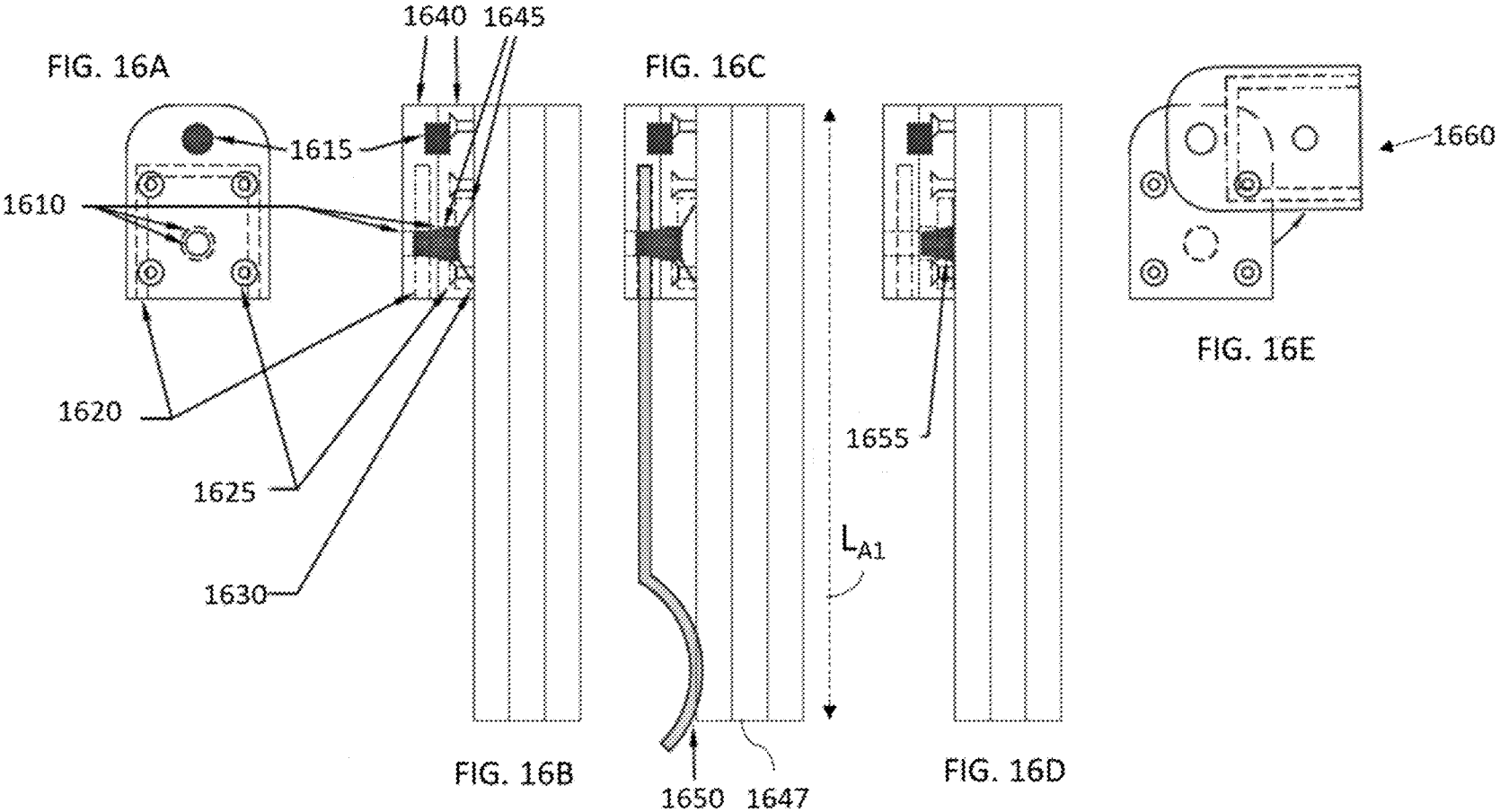
FIGS. 16A, 16B, 16C, 16D and 16E are illustrations showing a two piece base, in accordance with certain configurations.

In certain embodiments, the base may be a two-piece base as shown in FIGS. 16A-16E. In this configuration, the base 1640 consists of two pieces. A bottom/inner element is secured to the knife, e.g., using an external fastener, and an upper/outer element is connected to the bottom element at a pivot point. The outer element may also reversibly couple to a clip as described herein. A spring and plunger assembly 1645 (see FIG. 16B) are situated in the inner element. The spring/plunger 1645 can be depressed to release the outer element and permit rotation of the outer element. The spring/plunger 1645 can protrude through a hole in the inner element and through another hole 1610 in the outer element. Depressing the spring/plunger 1655 (see FIG. 16D) allows the outer element to pivot about the inner element (see pivoted element 1660 in FIG. 16E) at a pivot point 1615 (see FIG. 16B). When the spring/plunger 1655 protrudes through the outer element, pivoting is prevented. The plunger may be tapered if desired. In certain examples, the plunger may also protrude through an opening in a clip 1650 and serve to hold the clip 1650 in place within a slotted/recessed opening 1620 in the upper part of the base 1640. The clip may be held in place using other means or multiple plunger/springs may also be used. As shown in FIG. 16B, the bottom element of the base may couple to a knife 1649 using fasteners such as screws, rivets, bolts, etc. Openings 1625 in the base 1640 may receive the fasteners 1647 to attach the base 1640 to the knife 1649. A slot 1630 may be present in the inner element of the base 1640 to allow the spring to compress. When the clip 1650 is coupled to the base 1640, the clip is generally parallel with a longitudinal axis is generally parallel to a longitudinal axis $L_{A1}$ of the knife 1647. In some configurations, pivoting of the outer element away from the inner element can act to release the clip or otherwise permit removal of the clip. A different clip can then be installed, and the outer element can be pivoted back toward the inner element so the spring/plunger of the inner element can engage a hole or aperture in the outer element and lock the inner element to the outer element and hold the clip in place. If desired, the plunger could instead be present in the outer element and engage a hole or aperture in the inner element to couple the clip to the base. As noted in more detail below, a clip that includes one, two, three or more fingers can be used with a base such as the base shown in FIGS. 16A-16E. For example, fingers on the clip can engage recesses in the outer element of the base to couple the clip to the outer element, at least temporarily. Rotation of the clip, together or separately from pivoting of the outer element, can act to couple the clip to the base.

Figure 17A:
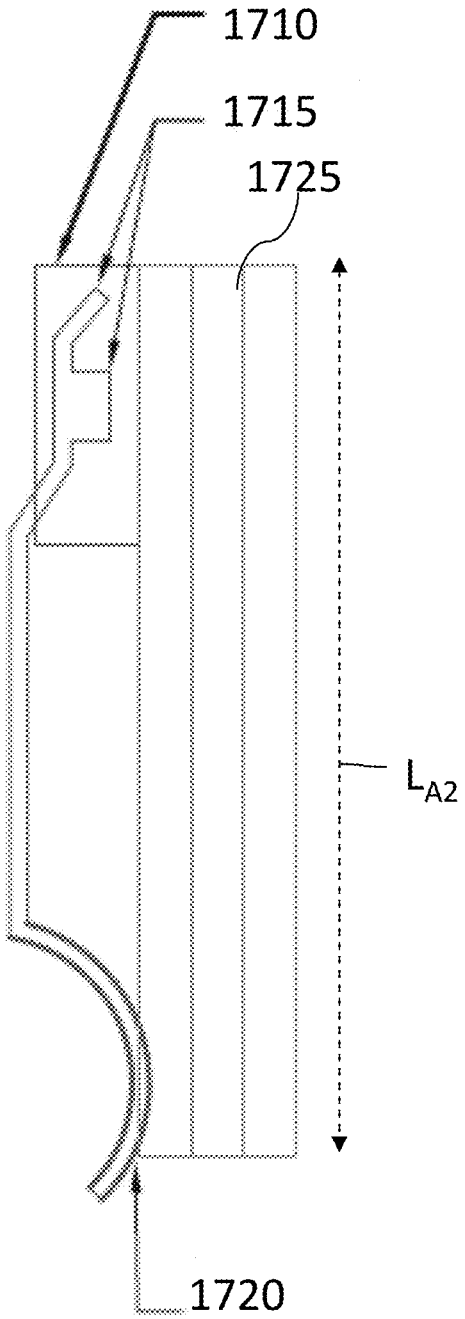
FIGS. 17A, 17B, 17C, 17D, 17E, 17F, 17G and 17H are illustrations showing a base with radial slots, in accordance with some examples.
Figure 17B:
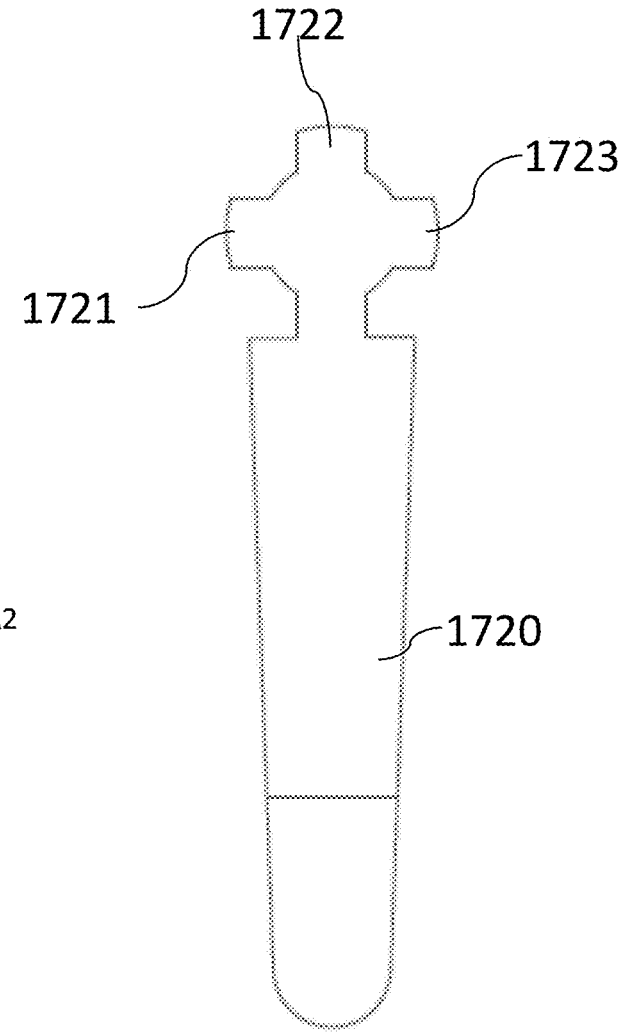
Figure 17C:
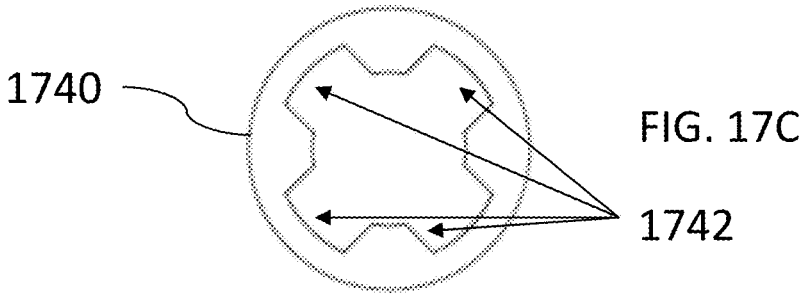
Figure 17D:
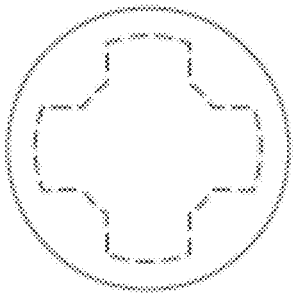
Figure 17E:
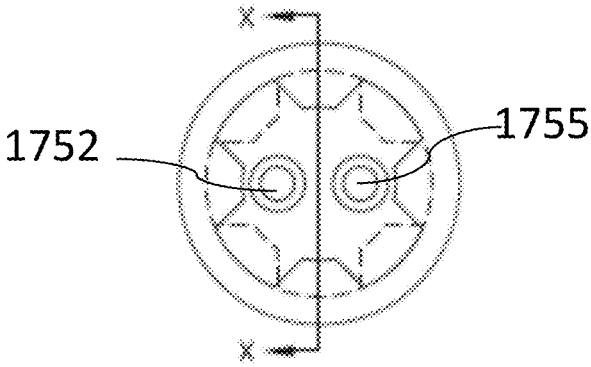
Figure 17F:
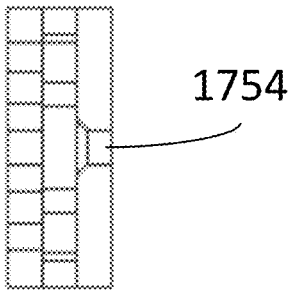
Figure 17G:
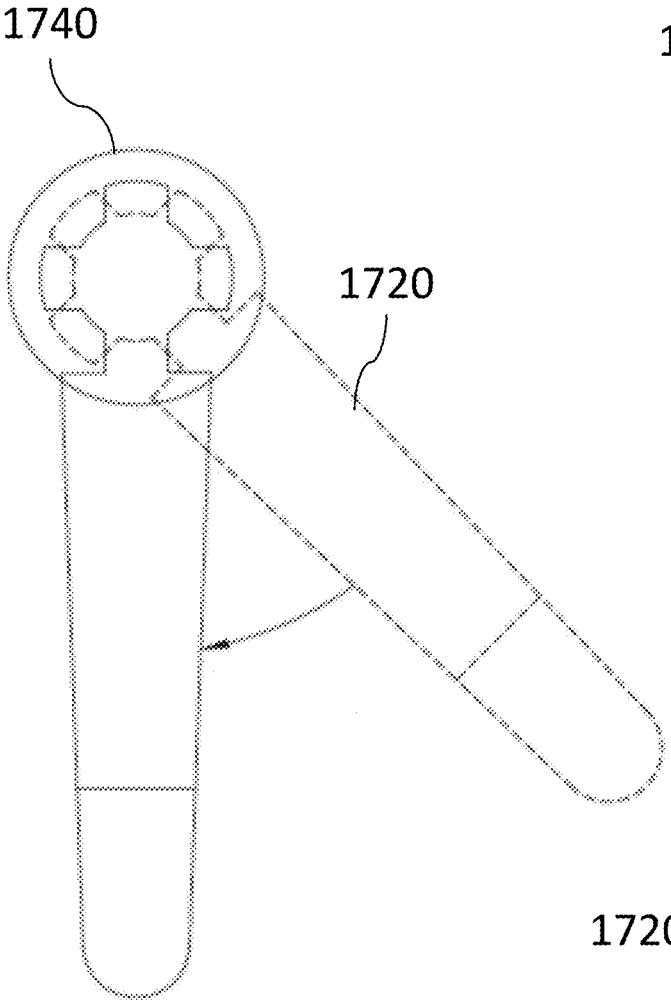
Figure 17H:
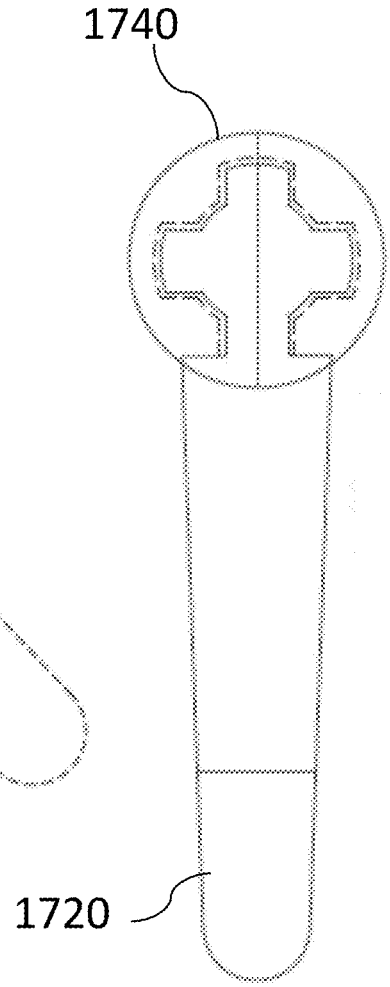

In certain embodiments, a base may comprise one or more radial slots that can engage a finger on the clip to lock the clip into place. Referring to FIGS. 17A and 17B, a base 1710 is shown that can receive fingers 1715 of a clip 1720. The fingers (collectively 1715) are bent downward and act as springs. While three fingers 1721, 1722, 1723 are shown in FIG. 17B, one, two, four or more fingers may be present if desired. A clip 1720 may sit below the end of a knife 1725 requiring user to slightly lift and end of the clip 1720 as it is rotated into position. As shown in FIG. 17A, when installed the clip 1720 is generally parallel to a longitudinal axis $L_{A2}$ of the knife 1725. This rotation can create additional force between the clip 1720 and the knife 1725 and can provide additional friction to hold the clip 1720 in place. FIG. 17C shows an external view of base 1740 that can include openings 1742 to receive the fingers 1721, 1722, 1723 from the clip 1720 from the outside. FIG. 17D is a partial section showing the interior recesses to receive the fingers 1721, 1722, 1723 of the clip 1720. FIG. 17E is an external view showing the recesses as dashed lines. Apertures or holes 1752, 1754 are shown that can receive screws or other fasteners to attach the base to the knife. A section X-X through FIG. 17E is shown in FIG. 17F, which better shows the holes for the screws of other fasteners. FIG. 17G shows rotation of the clip 1720 to secure it in the base 1710. The installed clip 1720 in the base 1710 is shown in FIG. 17H. The radial fingers of the clip 1720 engage radial slots of the base 1710. For example, a user can place the clip at a desired angle to the axis of the knife with installed base. After the fingers of the clip 1720 are inserted into the base 1740, the fingers of the clip 1720 can be pushed down. This action compresses the fingers and provides a spring force. The compressed finger and clip 1720 can then be rotated so the clip 1720 couples to the base 1740 and lines up with knife after rotation. The user may then release the force on the clip 1720, which allows the fingers to move upward into recesses of the base 1740. The upward movement retains the clip 1720 to the base 1740. The exact number of degrees that the clip rotates may vary. For example, the clip may rotate at least 10 degrees or at least 15 degrees or at least 20, 25, 30, 35, 40, 45 or 50 degrees. Where more fingers are present on the clip, the clip generally can be rotated fewer degrees to couple the clip to the base.

Figure 18A:
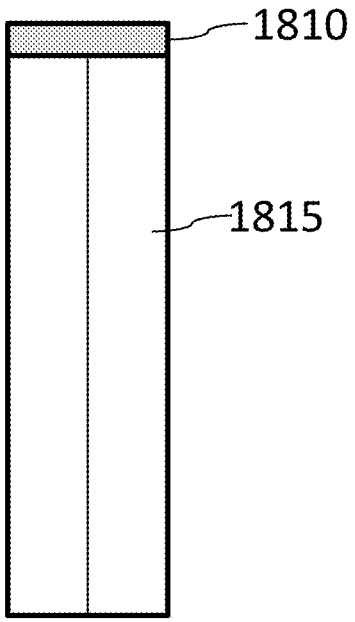
FIGS. 18A, 18B, 18C and 18D are illustrations of alternative configurations showing a base, in accordance with some embodiments.
Figure 18B:
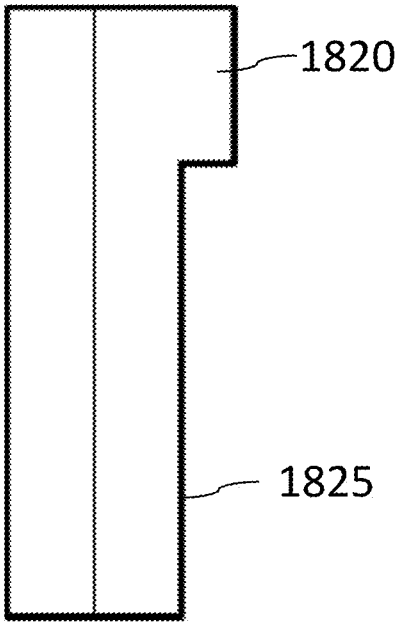
Figure 18C:
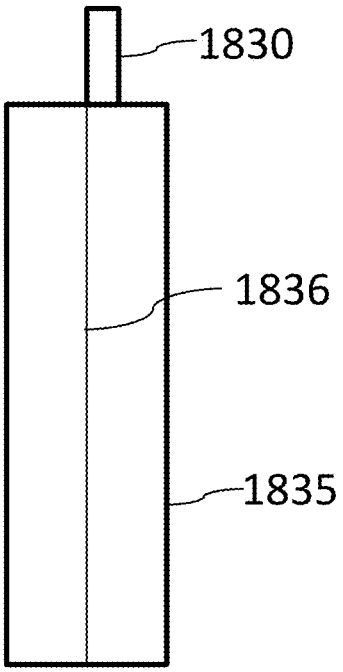
Figure 18D:
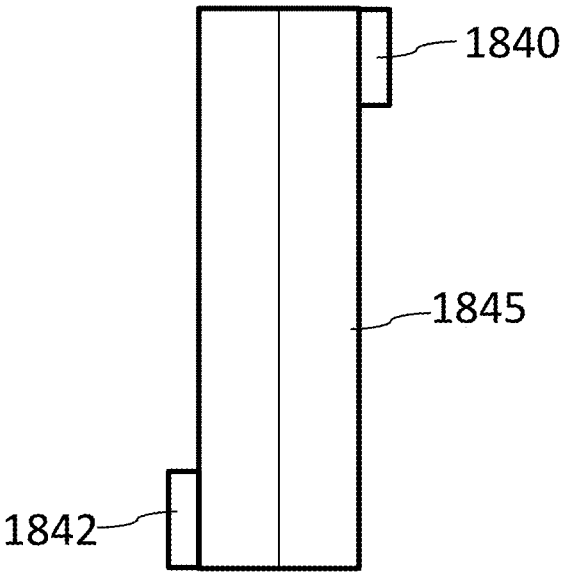
Figure 19A:
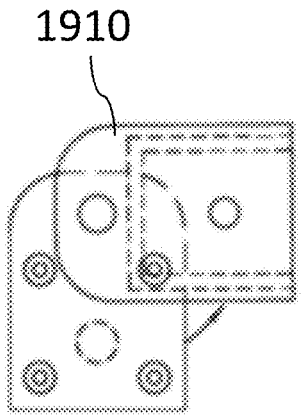
FIGS. 19A, 19B, 19C and 19D are illustrations of components that can be present in a kit.
Figure 19B:
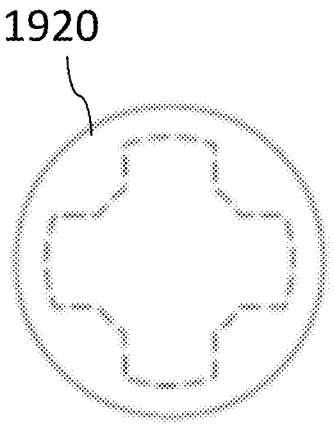
Figure 19C:
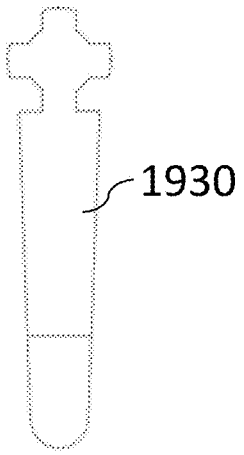
Figure 19D:
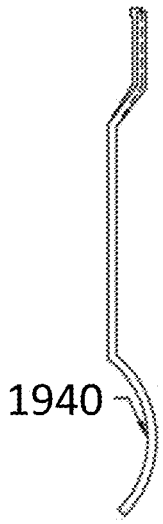

In certain embodiments, the bases and clips described herein may be present in other configurations. For example, FIG. 18A shows a knife housing 1815 with a base 1810 coupled to the knife housing 1815 at a top surface of the knife housing 1815. This arrangement may permit bi-directional coupling of the clip to the base 1810 to position the clip on different sides of the housing 1815. FIG. 18B shows a base 1820 that is integral to a knife housing 1825. FIG. 18C shows a base 1830 that couples to an interior member 1836 in a knife housing 1835. The interior member 1836 may be a liner or other inner feature of the knife. FIG. 18D shows a knife housing 1845 that is coupled to a first base 1840 and a second base 1842. The first base 1840 and the second base 1842 can be the same or can be different and can be on the same side of the housing 1845 or different sides of the housing 1845. In certain embodiments, the presence of two or more bases can allow for flexibility for placing the clip on either side. Alternatively, by including a single base, which can be integral if desired, at an end of the knife, the base can accept clips bi-directionally, thus allowing the same clip to work on either side of the knife handle.

In certain configurations, the clips and bases described herein can be present in a kit that includes written instructions to couple the clip to the base. FIGS. 19A, 19B, 19C and 19D show different bases 1910, 1920 and clips 1930, 1940 that may be present in a kit. Additional different bases and clips could instead be present or also be present in any one kit. For example a kit may include one, two, three or more bases and one, two, three or more clips. In some instances, the kit may only include different clips that can couple to a single type of base already present on a knife housing. In other instances, the kit may only include different bases that can be used with a specific type of clip but that may, for example, position the clip differently on the knife housing. The written instructions, which may be electronic instruction instead if desired, can provide guidance to couple the clips to the base and/or the base to the knife housing.

When introducing elements of the aspects, embodiments and examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A pocket knife clip assembly comprising:

a base configured to couple to a housing of the pocket knife, the housing sized and arranged to receive at least one knife blade; and a clip configured to removably couple to the base, wherein the clip comprises at least one finger that can reversibly couple to the base, wherein the at least one finger is configured to provide a spring force to retain the clip to the base after rotation of the clip to couple the clip to the base, and wherein rotation of the clip to couple the clip to the base aligns the clip parallel with a longitudinal axis of the pocket knife.

2. The pocket knife clip assembly of claim 1, in which the base is coupled to the housing of the pocket knife using one or more external fasteners or wherein the base is integral to the housing.

3. The pocket knife clip assembly of claim 1, in which the clip is configured to couple to the base through at least one slot on the base.

4. The pocket knife clip assembly of claim 1, in which the clip comprises a plurality of fingers, in which at least one finger is configured to engage a recess on the base.

5. The pocket knife clip assembly of claim 4, wherein the base comprises at least three recesses, and wherein a respective finger on the clip is configured to engage a respective recess on the base.

6. The pocket knife clip assembly of claim 5, wherein the clip is configured to rotate at least 10 degrees, relative to the longitudinal axis of the knife, after the respective finger engages the respective recess to lock the clip in place.

7. The pocket knife clip assembly of claim 1, wherein the base comprises a radial slot that can receive at least one finger of the clip and lock the clip in place as the at least one finger engages the radial slot of the base.

8. The pocket knife clip assembly of claim 1, wherein the base is configured to couple to the housing at an end of the housing to permit a bi-directional positioning of the clip.

9. A pocket knife clip assembly comprising:

a base configured to couple to a housing of the pocket knife, the housing sized and arranged to receive at least one knife blade, wherein the base comprises at least an inner element and at least one outer element that can pivot about the at least one inner element; and a clip configured to removably couple to the at least one outer element of the base without the use of any external fasteners, wherein the at least one outer element of the base is configured to pivot and align the clip parallel with a longitudinal axis of the pocket knife.

10. The pocket knife clip assembly of claim 9, wherein the at least one inner element comprises a spring and plunger, wherein the plunger is configured to engage the at least one outer element to retain the at least one outer element in place after pivoting of the at least one outer element.

11. The pocket knife clip assembly of claim 10, wherein the plunger is further configured to protrude through an opening in the clip to retain the clip to the at least one outer element and keep the clip parallel with a longitudinal axis of the pocket knife.

12. The pocket knife clip assembly of claim 9, wherein the at least one outer element is coupled to the inner element through a fastener configured to permit rotation of the at least one outer element.

13. The pocket knife clip assembly of claim 9, wherein the at least one outer element comprises a slot configured to receive the clip and align a hole in the clip with a hole in the at least one outer element when a plunger of the at least one inner element engages the hole in the at least one outer element and the hole in the clip.

14. The pocket knife clip assembly of 9, wherein the at least one inner element comprises a slot to permit the spring to compress.

15. The pocket knife clip assembly of claim 9, wherein the clip further comprises fingers configured to engage recesses on the at least one outer element of the base.

16. The pocket knife clip assembly of claim 10, wherein the at least one inner element further comprises a second plunger configured to engage a second hole on the at least one outer element to retain the at least one outer element in place.

17. The pocket knife clip assembly of claim 10, wherein the plunger is tapered.

18. A kit comprising the pocket knife assembly of claim 1.

19. The kit of claim 18, further comprising an additional clip.

20. The kit of claim 18, further comprising a second base different than the base.

21. A kit comprising the pocket knife assembly of claim 9.

22. The kit of claim 21, further comprising an additional clip.

23. The kit of claim 21, further comprising a second base different than the base.

* * * * *